US010648463B2

(12) United States Patent
Hirata

(10) Patent No.: US 10,648,463 B2
(45) Date of Patent: May 12, 2020

(54) GAS CONTROL DEVICE

(71) Applicant: Murata Manufacturing Co., Ltd., Kyoto (JP)

(72) Inventor: Atsuhiko Hirata, Kyoto (JP)

(73) Assignee: MURATA MANUFACTURING CO., LTD., Kyoto (JP)

( * ) Notice: Subject to any disclaimer, the term of this patent is extended or adjusted under 35 U.S.C. 154(b) by 845 days.

(21) Appl. No.: 15/079,888

(22) Filed: Mar. 24, 2016

(65) Prior Publication Data

US 2016/0201665 A1 Jul. 14, 2016

Related U.S. Application Data

(63) Continuation of application No. PCT/JP2014/072677, filed on Aug. 29, 2014.

(30) Foreign Application Priority Data

Sep. 24, 2013 (JP) ..... 2013-197073

(51) Int. Cl.
*F04B 45/04* (2006.01)
*F04B 49/08* (2006.01)
(Continued)

(52) U.S. Cl.
CPC ..... *F04B 45/043* (2013.01); *F04B 41/02* (2013.01); *F04B 41/06* (2013.01); *F04B 43/046* (2013.01);
(Continued)

(58) Field of Classification Search
CPC .. F04B 35/04; F04B 41/06; F04B 43/04–046; F04B 45/022; F04B 45/043;
(Continued)

(56) References Cited

U.S. PATENT DOCUMENTS 6,164,933 A * 12/2000 Tani ..... A61B 5/0235 417/413.2
8,668,465 B2 * 3/2014 Wadsley ..... F04B 1/28 417/216
(Continued)

FOREIGN PATENT DOCUMENTS

JP H01-100392 A 4/1989
JP H07-042440 U 8/1995
(Continued)

OTHER PUBLICATIONS

International Search Report issued in Application No. PCT/JP2014/072677 dated Nov. 25, 2014.
(Continued)

*Primary Examiner* — Alexander B Comley
(74) *Attorney, Agent, or Firm* — Pearne & Gordon LLP

(57) ABSTRACT

A gas control device (100) includes a first pump (101), a second pump (201), a first check valve (102), a second check valve (202), and a receptacle (9). The volume of the receptacle (9) changes in accordance with the pressure of air flowing thereinto. The first pump (101) has an air suction hole (53) and an air discharge hole (24). The second pump (201) has an air suction hole (197) and an air discharge hole (181). The first pump (101) is a type of pump having a high discharge flow rate and a low discharge pressure. The second pump (201) is a type of pump having a low discharge flow rate and a high discharge pressure. The suction hole (53) of the first pump (101) communicates with a first ventilation hole (106). The suction hole (197) of the second pump (201) communicates with a second ventilation hole (107).

21 Claims, 27 Drawing Sheets

(51) Int. Cl.

| | |
|---|---|
| ***F04B 41/02*** | (2006.01) |
| ***F04B 41/06*** | (2006.01) |
| ***F04B 45/047*** | (2006.01) |
| ***F04B 49/06*** | (2006.01) |
| ***F04B 49/02*** | (2006.01) |
| ***F04B 43/04*** | (2006.01) |
| ***F04B 51/00*** | (2006.01) |
| ***F04B 53/10*** | (2006.01) |
| ***F17C 5/06*** | (2006.01) |

(52) U.S. Cl.
CPC ..... *F04B 45/047* (2013.01); *F04B 49/022* (2013.01); *F04B 49/06* (2013.01); *F04B 49/08* (2013.01); *F04B 51/00* (2013.01); *F04B 53/10* (2013.01); *F04B 2205/01* (2013.01); *F04B 2205/05* (2013.01); *F17C 5/06* (2013.01)

(58) Field of Classification Search
CPC ..... F04B 45/047; F04B 41/02; F04B 49/022; F04B 49/06; F04B 49/08; A61H 9/0078
USPC ..... 417/413.2, 62, 244, 246, 248, 417/413.1–413.3, 426–429; 601/152
See application file for complete search history.

(56) References Cited

U.S. PATENT DOCUMENTS

| | | | | |
|---|---|---|---|---|
| 2006/0147325 | A1* | 7/2006 | Vogeley | F04B 9/105 417/413.2 |
| 2011/0076170 | A1* | 3/2011 | Fujisaki | F04B 45/047 417/415 |
| 2013/0058809 | A1 | 3/2013 | Hirata | |
| 2014/0094727 | A1* | 4/2014 | Deshpande | A61H 9/005 601/152 |

FOREIGN PATENT DOCUMENTS

| | | | | |
|---|---|---|---|---|
| JP | 09184482 | A | * | 7/1997 |
| JP | H09-184482 | A | | 7/1997 |
| JP | 4563767 | B2 | | 10/2010 |
| JP | 2013-068215 | A | | 4/2013 |
| WO | 2009/148008 | A1 | | 12/2009 |

OTHER PUBLICATIONS

Written Opinion issued in Application No. PCT/JP2014/072677 dated Nov. 25, 2014.

* cited by examiner

GAS CONTROL DEVICE

BACKGROUND OF THE DISCLOSURE

Field of the Disclosure

This disclosure relates to a gas control device that fills a receptacle with a gas using a pump.

Description of the Related Art

Various types of pumps that suction a gas and discharge the gas have been proposed thus far. For example, Patent Document 1 discloses a piezoelectric microblower, and Patent Document 2 discloses a piezoelectric pump.

The pressure-flow rate characteristics (called "PQ characteristics" hereinafter) of the pumps including the piezoelectric microblower according to Patent Document 1 and the piezoelectric pump according to Patent Document 2 are, when the flow rate is represented by Q [L/min] and the pressure is represented by P [kPa], expressed by the formula $P=Pmax\ (1-Q/Qmax)$. This formula is linear, expressing a relationship in which the obtained pressure P is a maximum pressure Pmax in the case where the flow rate Q is 0, and the obtained pressure P is 0 in the case where the flow rate Q is a maximum flow rate Qmax.

Patent Document 1: International Publication No. WO 2009/148008 pamphlet

Patent Document 2: Japanese Unexamined Patent Application Publication No. 2013-68215

BRIEF SUMMARY OF THE DISCLOSURE

Results of investigations made by the inventors of the present application will be described below. A receptacle having characteristics in which the volume thereof changes in accordance with the pressure of a gas flowing thereinto does not require linear PQ characteristics. A swimming ring and a balloon are examples of such a receptacle.

FIG. 22 is a graph illustrating the relationship between the pressure of a gas flowing into a swimming ring and the volume of the swimming ring. FIG. 23 is a graph illustrating the relationship between the pressure of a gas flowing into a balloon and the volume of the balloon.

For example, when filling a swimming ring with air, a high discharge pressure is not very necessary, but a high discharge flow rate is necessary, during a period from a maximum deflated state, in which the swimming ring is not filled with any air at all, to a partially inflated state, in which the swimming ring is filled with a certain amount of air, as illustrated in FIG. 22. A low discharge flow rate is sufficient, but a high discharge pressure is necessary, during a period from the partially inflated state to a maximum inflated state, where the swimming ring is completely filled with air.

Meanwhile, as illustrated in FIG. 23, when filling a balloon with air, for example, a high discharge pressure is not very necessary during a period from a maximum deflated state, in which the balloon is not filled with any air at all, to a partially deflated state, in which the balloon is filled with a small amount of air. However, an extremely high discharge pressure is necessary for an instant immediately after the partially deflated state, and once that instant passes, the balloon can be filled with air even at a low discharge pressure, but a high discharge flow rate is necessary.

Accordingly, when filling a swimming ring with air using a type of pump having a high discharge flow rate and a low discharge pressure (the piezoelectric microblower according to Patent Document 1, for example), it is difficult to bring the swimming ring from the partially inflated state to the maximum inflated state. On the other hand, when filling a swimming ring with air using a type of pump having a low discharge flow rate and a high discharge pressure (the piezoelectric pump according to Patent Document 2, for example), it takes an extremely long time to bring the swimming ring from the maximum deflated state to the partially inflated state.

Furthermore, when filling a balloon with air using a type of pump having a high discharge flow rate and a low discharge pressure (the piezoelectric microblower according to Patent Document 1, for example), it is difficult to inflate the balloon beyond the partially deflated state. On the other hand, when filling a balloon with air using a type of pump having a low discharge flow rate and a high discharge pressure (the piezoelectric pump according to Patent Document 2, for example), after passing the instant where the extremely high discharge pressure is necessary, it takes an extremely long time to inflate the balloon thereafter.

Accordingly, it is an object of the present disclosure to provide a gas control device capable of quickly filling, with a gas, a receptacle having characteristics in which the volume thereof changes in accordance with the pressure of the gas flowing thereinto.

To solve the aforementioned problem, a gas control device according to the present disclosure has the following configuration.

(1) A gas control device includes a first pump having a first suction hole and a first discharge hole for a gas, and a second pump having a second suction hole and a second discharge hole for the gas, wherein a maximum flow rate at which the first pump is capable of discharging the gas from the first discharge hole is greater than a maximum flow rate at which the second pump is capable of discharging the gas from the second discharge hole, a maximum pressure at which the second pump is capable of discharging the gas from the second discharge hole is greater than a maximum pressure at which the first pump is capable of discharging the gas from the first discharge hole, and the first discharge hole and the second discharge hole are connected to a receptacle having characteristics in which a volume of the receptacle changes in accordance with the pressure of the gas flowing into the receptacle.

According to this configuration, the first pump sends the gas to the receptacle at a high discharge flow rate. The second pump sends the gas to the receptacle at a high discharge pressure. The gas control device according to the present disclosure can therefore achieve both high flow rate characteristics and high pressure characteristics.

The gas control device according to the present disclosure uses the high flow rate characteristics and the high pressure characteristics in accordance with PQ characteristics required by the receptacle. For example, the gas control device according to the present disclosure drives the second pump after driving the first pump, drives the first pump after driving the second pump, and so on in accordance with the PQ characteristics required by the receptacle. The gas control device according to the present disclosure can therefore quickly fill the receptacle, which has characteristics in which a volume thereof changes in accordance with the pressure of the gas flowing thereinto, with gas.

(2) Preferably, the gas control device includes a first check valve that prevents the gas from flowing to the first discharge hole from the interior of the receptacle.

According to this configuration, the first check valve closes upon the pressure of the gas flowing into the receptacle exceeding the discharge pressure of the first pump. The gas control device having this configuration can therefore prevent the gas from flowing back to the first discharge hole of the first pump from the receptacle.

(3) Preferably, the gas control device includes a second check valve that prevents the gas from flowing to the second discharge hole from the interior of the receptacle.

According to this configuration, the second check valve closes upon the pressure of the gas flowing into the receptacle exceeding the discharge pressure of the second pump. The gas control device having this configuration can therefore prevent the gas from flowing back to the second discharge hole of the second pump from the receptacle, even when the second pump is not being driven.

(4) Preferably, the gas control device includes a detecting unit that detects a pressure of the gas in the receptacle, and a control unit that starts driving one of the first pump and the second pump, wherein the control unit monitors the pressure in the receptacle on the basis of an output of the detecting unit after starting driving the one of the first pump and the second pump, and starts driving the other pump in response to a rise in the pressure.

According to this configuration, the control unit specifies timings for the start of driving to each pump on the basis of a value of the pressure in the receptacle.

(5) Preferably, the gas control device includes a third pump having a third suction hole and a third discharge hole for the gas, wherein the maximum flow rate at which the first pump is capable of discharging the gas from the first discharge hole is greater than a maximum flow rate at which the third pump is capable of discharging the gas from the third discharge hole, a maximum pressure at which the third pump is capable of discharging the gas from the third discharge hole is greater than the maximum pressure at which the first pump is capable of discharging the gas from the first discharge hole, and the third discharge hole is connected to the second suction hole.

According to this configuration, the first pump sends the gas to the receptacle at a high discharge flow rate. The second pump sends the gas to the receptacle at a high discharge pressure. Furthermore, the second pump and the third pump are connected in series, and thus driving those pumps simultaneously send the gas to the receptacle at a higher discharge pressure. The gas control device according to this configuration can also therefore achieve both high flow rate characteristics and high pressure characteristics.

Furthermore, the gas control device according to this configuration also uses the high flow rate characteristics and the high pressure characteristics in accordance with PQ characteristics required by the receptacle. For example, the gas control device according to the present disclosure drives the first pump, then drives the second pump, and then drives the third pump in accordance with the PQ characteristics required by the receptacle. The gas control device according to this configuration also can therefore quickly fill the receptacle, which has characteristics in which a volume thereof changes in accordance with the pressure of the gas flowing thereinto, with gas.

(6) Preferably, the gas control device includes a fourth pump having a fourth suction hole and a fourth discharge hole for the gas, wherein a maximum flow rate at which the fourth pump is capable of discharging the gas from the fourth discharge hole is greater than the maximum flow rate at which the second pump is capable of discharging the gas from the second discharge hole, the maximum pressure at which the second pump is capable of discharging the gas from the second discharge hole is greater than a maximum pressure at which the fourth pump is capable of discharging the gas from the fourth discharge hole, and the fourth discharge hole is connected to the receptacle.

According to this configuration, the first pump sends the gas to the receptacle at a high discharge flow rate. The second pump sends the gas to the receptacle at a high discharge pressure. Furthermore, the fourth pump sends the gas to the receptacle at a high discharge flow rate. The gas control device according to this configuration can also therefore achieve both high flow rate characteristics and high pressure characteristics.

Furthermore, the gas control device according to this configuration also uses the high flow rate characteristics and the high pressure characteristics in accordance with PQ characteristics required by the receptacle. For example, the gas control device according to the present disclosure drives the first and fourth pumps, then drives the second pump and the third pump in order, in accordance with the PQ characteristics required by the receptacle. The gas control device according to this configuration also can therefore quickly fill the receptacle, which has characteristics in which a volume thereof changes in accordance with the pressure of the gas flowing thereinto, with gas.

(7) Preferably, at least one of the first pump and the second pump includes a piezoelectric element serving as an actuator and a vibrating plate, having a first main surface bonded to the piezoelectric element, that bends and vibrates due to the piezoelectric element expanding and contracting.

According to this configuration, using a piezoelectric element as an actuator makes it possible to achieve a high flow rate and high pressure while maintaining a small size.

(8) Preferably, the first pump includes a first housing that is bonded to the vibrating plate and forms a pump chamber along with the vibrating plate, and a second housing that covers the first housing with a gap provided therebetween and forms a ventilation channel between the first housing and the second housing, wherein a ventilation hole that enables the interior and the exterior of the pump chamber to communicate is provided in the first housing, and the discharge hole is provided in a region of the second housing that opposes the ventilation hole.

According to this configuration, when a driving voltage is applied to the piezoelectric element, the vibrating plate bends and vibrates due to the piezoelectric element expanding and contracting. The volume of the pump chamber changes periodically in response to the vibrating plate bending and vibrating. Accordingly, the gas outside of the first pump is suctioned into the pump chamber from the ventilation hole, and the gas in the pump chamber is discharged from the ventilation hole.

According to this configuration, gas present outside of the first pump is pulled in through the ventilation channel and discharged from the discharge hole due to the gas being discharged from the pump chamber through the ventilation hole. Accordingly, the flow rate of the gas discharged from the discharge hole increases by an amount equivalent to the flow rate of the gas pulled in.

As such, according to the first pump configured in this manner, a high discharge flow rate can be achieved while maintaining a small size.

(9) Preferably, the second pump includes a frame plate that surrounds a periphery of the vibrating plate, a connecting portion that connects the vibrating plate to the frame plate and elastically supports the vibrating plate on the frame plate, and a plate that opposes a second main surface of the vibrating plate on the side opposite from the first main surface and in which a ventilation hole is provided.

According to this configuration, a peripheral edge portion of the vibrating plate is substantially unfixed. Furthermore, according to this configuration, when a driving voltage is applied to the piezoelectric element, the vibrating plate bends and vibrates due to the expansion and contraction of the piezoelectric element, and the plate also vibrates in response to the vibration of the vibrating plate. Through this, the gas is suctioned from the ventilation hole and discharged from the discharge hole.

As such, according to the second pump having this configuration, a high discharge pressure can be achieved while maintaining a small size.

In addition, a gas control device according to the present disclosure has the following configuration.

(10) A gas control device includes a first pump having a first suction hole and a first discharge hole for a gas, and a second pump having a second suction hole and a second discharge hole for the gas, wherein a maximum flow rate at which the first pump is capable of suctioning the gas from the first suction hole is greater than a maximum flow rate at which the second pump is capable of suctioning the gas from the second suction hole, a maximum suction pressure at which the second pump is capable of suctioning the gas from the second suction hole is greater than a maximum suction pressure at which the first pump is capable of suctioning the gas from the first suction hole, and the first suction hole and the second suction hole are connected to a receptacle having characteristics in which a volume of the receptacle changes in accordance with the pressure of the gas remaining in the receptacle.

According to this configuration, the first pump suctions the gas from the receptacle at a high suction flow rate. The second pump suctions the gas from the receptacle at a high suction pressure. The gas control device according to the present disclosure can therefore achieve both high flow rate characteristics and high pressure characteristics.

The gas control device according to the present disclosure uses the high flow rate characteristics and the high pressure characteristics in accordance with PQ characteristics required by the receptacle. For example, the gas control device according to the present disclosure drives the second pump after driving the first pump, drives the first pump after driving the second pump, and so on in accordance with the PQ characteristics required by the receptacle. The gas control device according to the present disclosure can therefore quickly suction gas from the receptacle, which has characteristics in which a volume thereof changes in accordance with the pressure of the gas remaining therein.

(11) Preferably, the gas control device includes a third check valve that prevents the gas from flowing into the receptacle from the first suction hole.

According to this configuration, the third check valve closes upon the pressure of the gas in the receptacle dropping below the suction pressure of the first pump. Accordingly, the gas control device according to this configuration can prevent the gas from flowing back from the first suction hole into the receptacle.

(12) Preferably, the gas control device includes a fourth check valve that prevents the gas from flowing into the receptacle from the second suction hole.

According to this configuration, the fourth check valve closes upon the pressure of the gas in the receptacle dropping below the suction pressure of the second pump. Accordingly, the gas control device according to this configuration can prevent the gas from flowing back from the second suction hole into the receptacle even when the second pump is not being driven.

(13) Preferably, the gas control device includes a detecting unit that detects a pressure of the gas in the receptacle, and a control unit that starts driving one of the first pump and the second pump, wherein the control unit monitors the pressure in the receptacle on the basis of an output of the detecting unit after starting driving the one of the first pump and the second pump, and starts driving the other pump in response to a drop in the pressure.

According to this configuration, the control unit specifies timings for the start of driving to each pump on the basis of a value of the pressure in the receptacle.

According to this disclosure, a receptacle, which has characteristics in which a volume thereof changes in accordance with the pressure of a gas flowing thereinto, can be quickly filled with gas.

In addition, according to this disclosure, gas can be quickly suctioned from a receptacle, which has characteristics in which a volume thereof changes in accordance with the pressure of a gas flowing thereinto.

BRIEF DESCRIPTION OF THE SEVERAL VIEWS OF THE DRAWINGS

Each of FIGS. 7A and 7B is a cross-sectional view of the first pump 101 indicated in FIG. 1, taken along an S-S line, when the first pump 101 is resonance-driven at a frequency (base wave) of a primary vibrating mode of the pump main body.

DETAILED DESCRIPTION OF THE DISCLOSURE

First Embodiment of the Present Disclosure

A gas control device 100 according to a first embodiment of the present disclosure will be described hereinafter.

Figure 1:
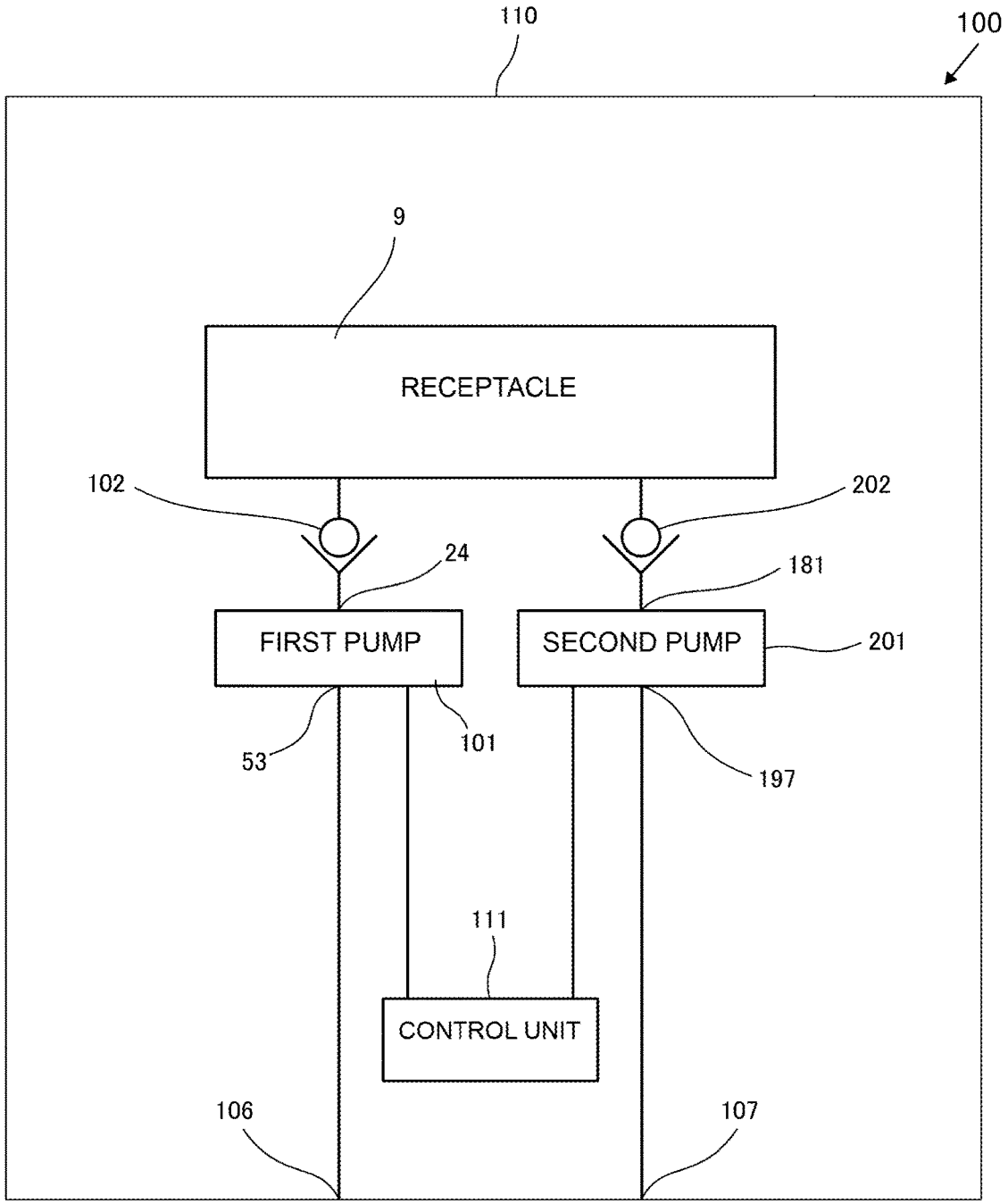
FIG. 1 is a block diagram illustrating the configuration of the primary elements of a gas control device 100 according to a first embodiment of the present disclosure.
Figure 2:
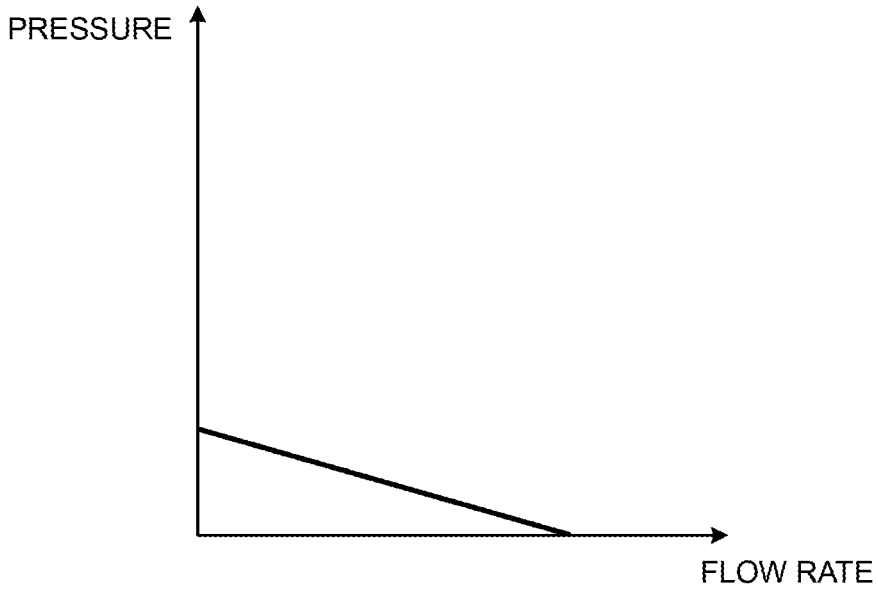
FIG. 2 is a graph illustrating PQ characteristics of a first pump 101 indicated in FIG. 1.
Figure 3:
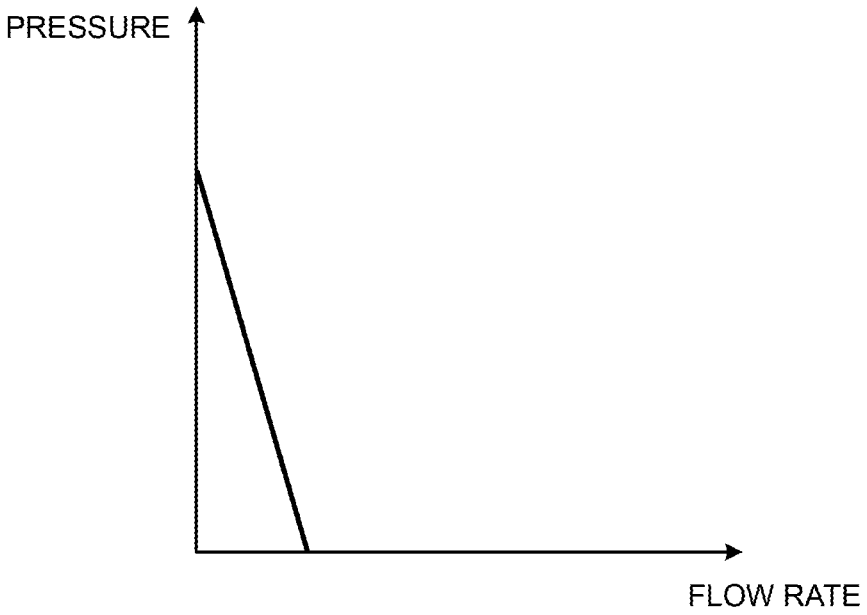
FIG. 3 is a graph illustrating PQ characteristics of a second pump 201 indicated in FIG. 1.

FIG. 1 is a block diagram illustrating the configuration of the primary elements of the gas control device 100 according to the first embodiment of the present disclosure. FIG. 2 is a graph illustrating PQ characteristics (pressure-flow rate characteristics) of a first pump 101 indicated in FIG. 1. FIG. 3 is a graph illustrating the PQ characteristics of a second pump 201 indicated in FIG. 1.

The gas control device 100 includes the first pump 101, the second pump 201, a first check valve 102, a second check valve 202, and a flexible receptacle 9.

The receptacle 9 has characteristics in which the volume thereof changes in accordance with the pressure of air flowing thereinto. The receptacle 9 is an air bladder. The gas control device 100 is a massage device that massages a user by inflating or deflating the air bladder. A relationship between the pressure of the gas that flows into the air bladder and the volume of the air bladder is the same as the relationship between the pressure of the gas that flows into the swimming ring and the volume of the swimming ring (see FIG. 22).

A housing 110 of the gas control device 100 is formed from a first ventilation hole 106 that enables the interior and the exterior of the housing 110 to communicate, a second ventilation hole 107 that enables the interior and the exterior of the housing 110 to communicate, and flow channels that connect the respective holes.

The first pump 101 has an air suction hole 53 and an air discharge hole 24. The second pump 201 has air suction holes 197 and an air discharge hole 181.

The first pump 101 is a pump having the PQ characteristics indicated in FIG. 2. In other words, the first pump 101 is a type of pump having a high discharge flow rate and a low discharge pressure. The second pump 201 is a pump having the PQ characteristics indicated in FIG. 3. In other words, the second pump 201 is a type of pump having a low discharge flow rate and a high discharge pressure.

A maximum flow rate of air that the first pump 101 is capable of discharging from the discharge hole 24 is greater than a maximum flow rate of air that the second pump 201 is capable of discharging from the discharge hole 181. A maximum pressure of air that the second pump 201 is capable of discharging from the discharge hole 181 is greater than a maximum pressure of air that the first pump 101 is capable of discharging from the discharge hole 24.

Here, the suction hole 53 of the first pump 101 communicates with the first ventilation hole 106. The suction holes 197 of the second pump 201 communicate with the second ventilation hole 107. The first pump 101 and the second pump 201 are connected in parallel to the receptacle 9 with the first check valve 102 and the second check valve 202 interposed therebetween. The discharge hole 24 of the first pump 101 therefore communicates with the interior of the receptacle 9. Likewise, the discharge hole 181 of the second pump 201 communicates with the interior of the receptacle 9.

The first check valve 102 prevents air from flowing from the interior of the receptacle 9 to the discharge hole 24. The second check valve 202 prevents air from flowing from the interior of the receptacle 9 to the discharge hole 181.

A control unit 111 is constituted of a microcomputer, for example, and controls the operations of the various elements in the gas control device 100. The control unit 111 includes a timer circuit that measures time.

Next, the structures of the first pump 101 and the second pump 201 will be described in detail.

First, the structure of the first pump 101 will be described in detail using FIGS. 4 to 6.

Figure 4:
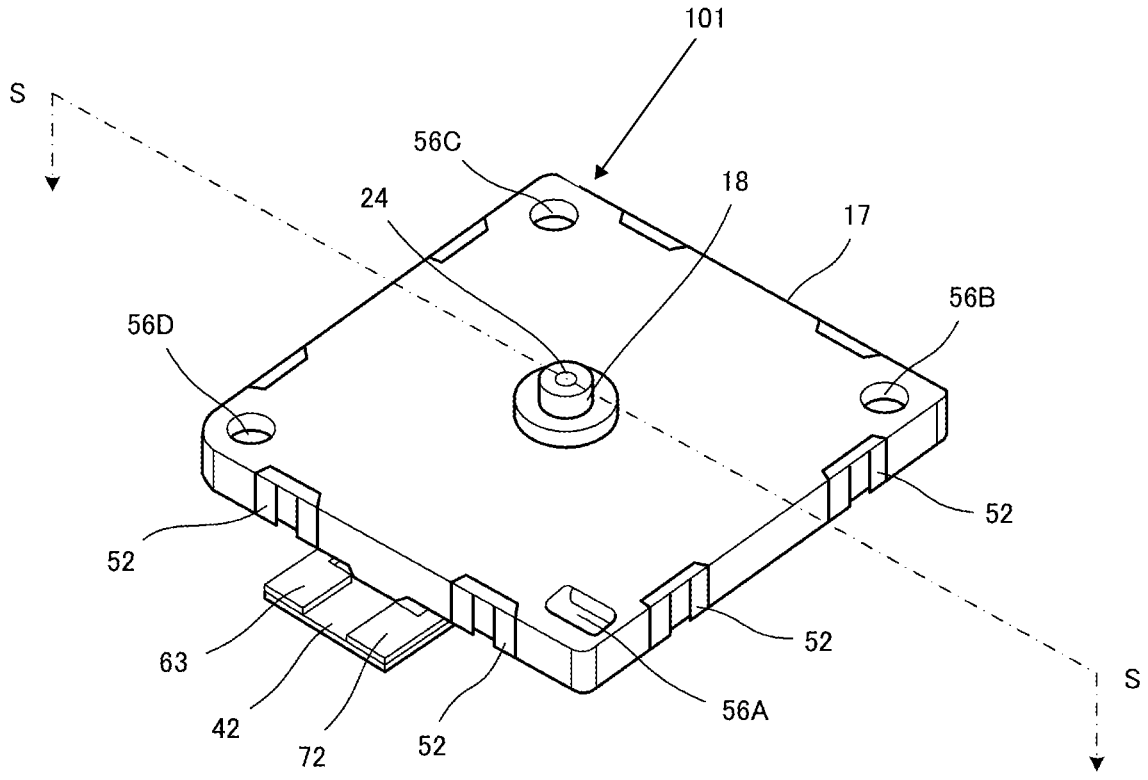
FIG. 4 is an external perspective view of the first pump 101 indicated in FIG. 1.

FIG. 4 is an external perspective view of the first pump 101 indicated in FIG. 1. FIG. 5 is an exploded perspective view of the first pump 101 indicated in FIG. 1. FIG. 6 is a cross-sectional view of the first pump 101 indicated in FIG. 4, taken along an S-S line.

The first pump 101 has a structure in which an outer housing 17, a top plate 37, a side plate 38, a vibrating plate 39, a piezoelectric element 40, and a cap 42 are stacked in that order from the top. The top plate 37, the side plate 38, and the vibrating plate 39 constitute a pump chamber 36. The first pump 101 has a width of 20 mm, a length of 20 mm, and a height of 1.85 mm in regions aside from a nozzle 18.

Note that the top plate 37 and the side plate 38 constitute a "first housing" according to the present disclosure. The outer housing 17 corresponds to a "second housing" according to the present disclosure. The top plate 37, the side plate 38, the vibrating plate 39, and the piezoelectric element 40 constitute a pump main body.

The outer housing 17 includes the nozzle 18, in the center of which the discharge hole 24 for discharging air is provided, for example. The nozzle 18 has an outer diameter of 2.0 mm, an inner diameter (in other words, the diameter of the discharge hole 24) of 0.8 mm, and a height of 1.6 mm. Screw holes 56A to 56D are provided in the four corners of the outer housing 17.

The outer housing 17 has a bracket shape (a C shape) that opens downward, when viewed as a cross-section. The outer housing 17 houses the top plate 37 of the pump chamber 36, the side plate 38 of the pump chamber 36, the vibrating plate 39, and the piezoelectric element 40. The outer housing 17 is formed from a resin, for example.

The top plate 37 of the pump chamber 36 is a circular plate, and is formed from a metal, for example. A central portion 61, key-shaped projecting portions 62 that project from the central portion 61 in the horizontal direction and make contact with an inner wall of the outer housing 17, and an external terminal 63 for connecting to an external circuit are provided in the top plate 37.

Meanwhile, a ventilation hole 45 that enables the interior of the pump chamber 36 to communicate with the exterior is provided in the central portion 61 of the top plate 37. The ventilation hole 45 is provided in a position that opposes the discharge hole 24 of the outer housing 17. The top plate 37 is provided on an upper surface of the side plate 38.

The side plate 38 of the pump chamber 36 has a ring shape, and is formed from a metal, for example. The side plate 38 is provided on an upper surface 39A of the vibrating plate 39. Accordingly, the thickness of the side plate 38 is the same as the height of the pump chamber 36.

The vibrating plate 39 is a circular plate, and is formed from a metal, for example. Along with the side plate 38 and the top plate 37, the vibrating plate 39 constitutes the pump chamber 36.

The piezoelectric element 40 is a circular plate, and is configured of a PZT-based ceramic material, for example. The piezoelectric element 40 expands and contracts in response to an AC driving voltage applied thereto. The piezoelectric element 40 is provided on a lower surface 39B of the vibrating plate 39, located on the opposite side as the pump chamber 36.

A joined body constituted of the top plate 37, the side plate 38, the vibrating plate 39, and the piezoelectric element 40 is elastically supported in the outer housing 17 by the four projecting portions 62 provided in the top plate 37.

An electrode conducting plate 70 is constituted of an internal terminal 73 connected to the piezoelectric element 40 and an external terminal 72 connected to an external circuit. A tip of the internal terminal 73 is soldered to a planar surface of the piezoelectric element 40. The internal terminal 73 can be better suppressed from vibrating by having the soldering position match the position of a node where the piezoelectric element 40 bends and vibrates.

The circular plate-shaped suction hole 53 is provided in the cap 42. The suction hole 53 has a greater diameter than the piezoelectric element 40. Meanwhile, cutouts 55A to 55D are provided in the cap 42, in positions corresponding to the screw holes 56A to 56D of the outer housing 17.

The cap 42 also has, in its outer peripheral edge, projecting portions 52 that project toward the top plate 37. The cap 42 holds the outer housing 17 using the projecting portions 52, and houses the top plate 37 of the pump chamber 36, the side plate 38 of the pump chamber 36, the vibrating plate 39, and the piezoelectric element 40 along with the outer housing 17. The cap 42 is formed from a resin, for example.

Figure 6:
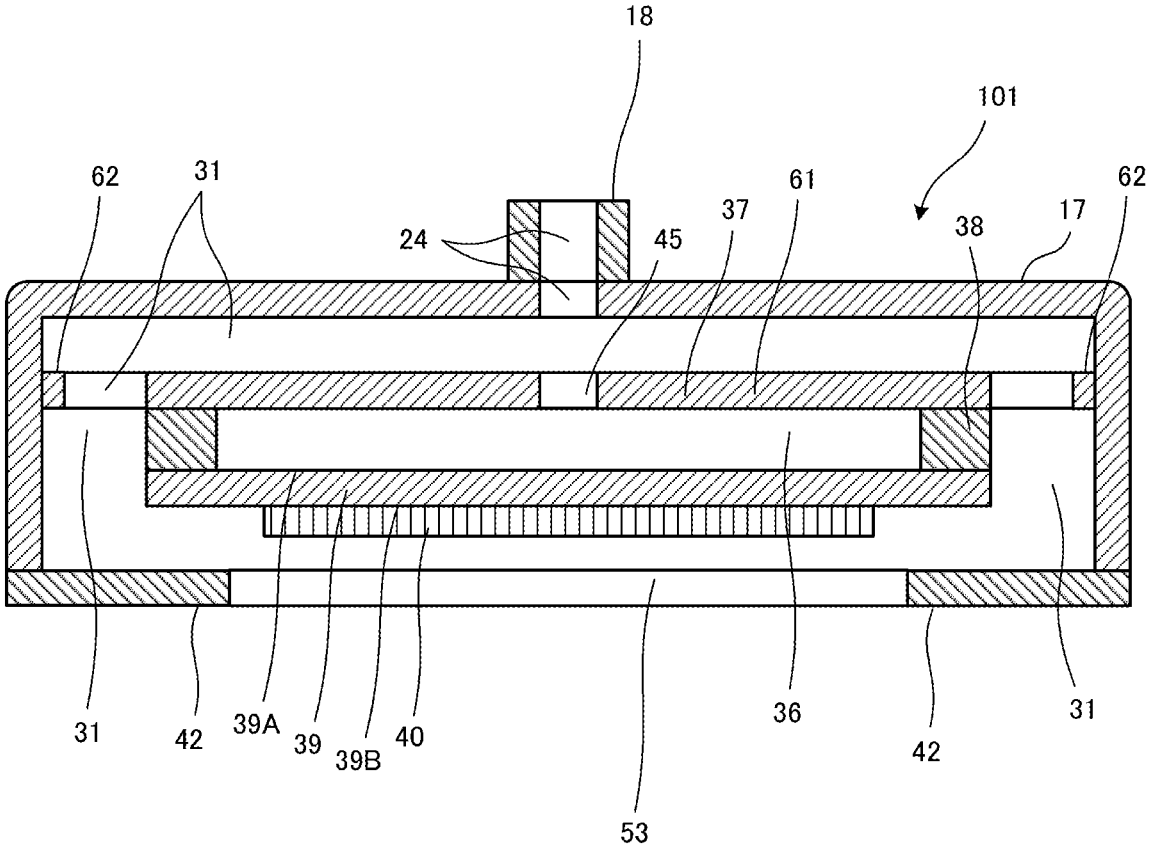
FIG. 6 is a cross-sectional view of the first pump 101 indicated in FIG. 4, taken along an S-S line.

As illustrated in FIG. 6, a ventilation channel 31 is provided between the outer housing 17 and the cap 42, and the joined body, which is constituted of the top plate 37, the side plate 38, the vibrating plate 39, and the piezoelectric element 40.

Next, the flow of air when the first pump 101 is being driven will be described.

Figure 7A:
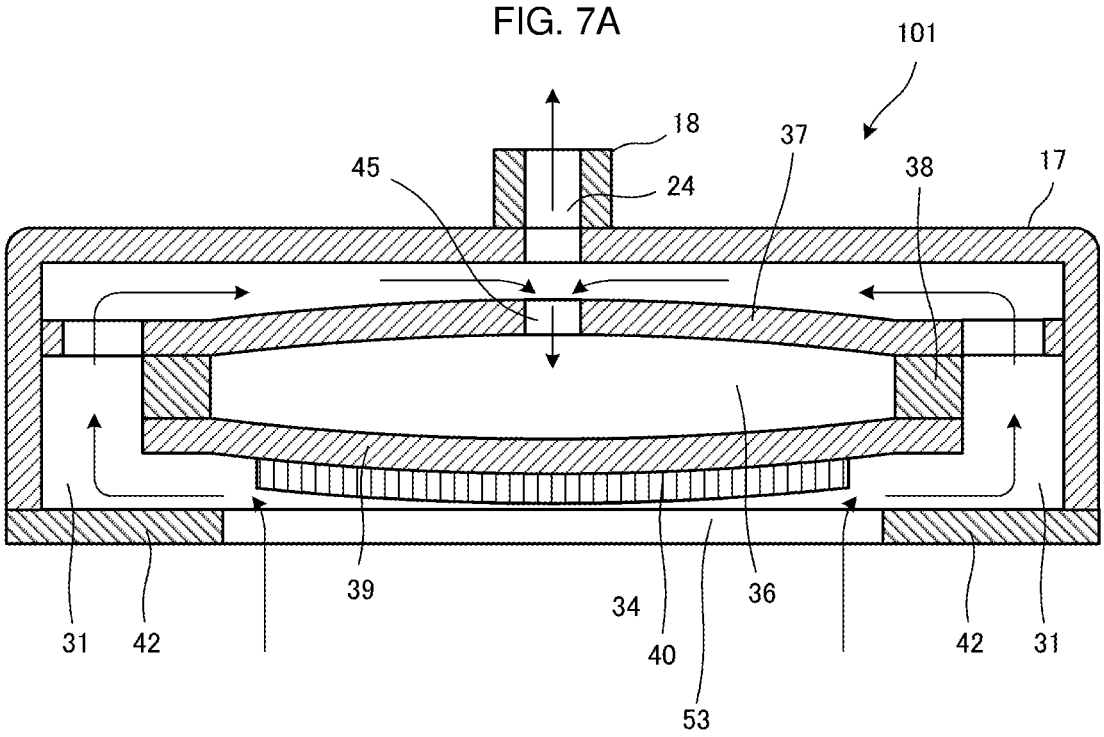
FIG. 7A is a diagram illustrating a state where the volume of a pump chamber has increased.
Figure 7B:
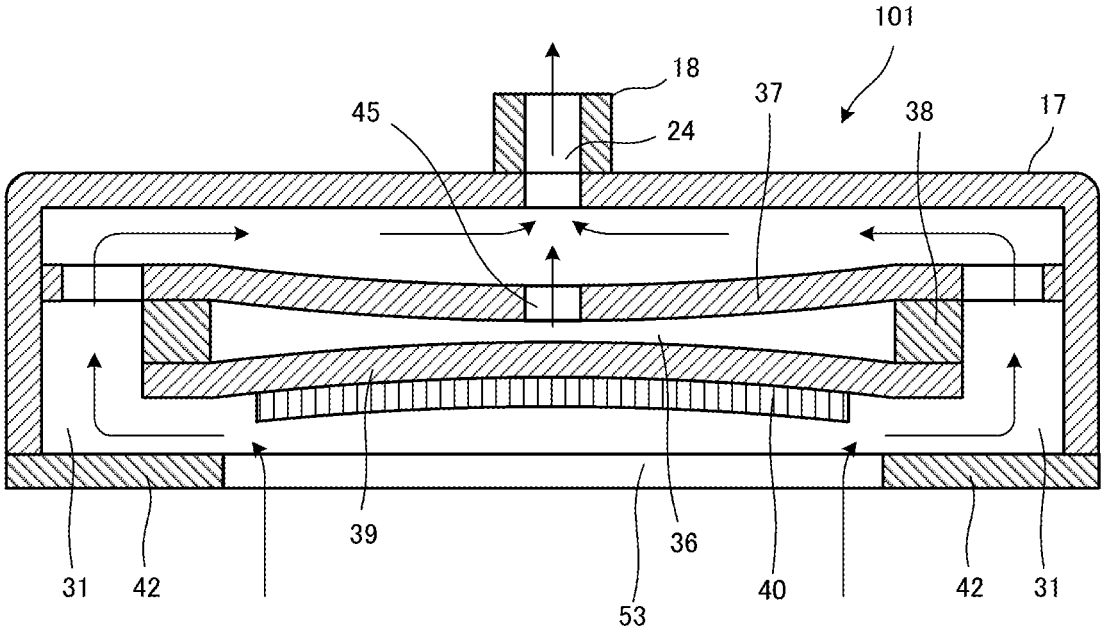
FIG. 7B is a diagram illustrating a state where the volume of the pump chamber has decreased.

FIGS. 7A and 7B are cross-sectional views of the first pump 101 indicated in FIG. 1, taken along the S-S line, when the first pump 101 is resonance-driven at a frequency (base wave) of a primary vibrating mode of the pump main body. The arrows in FIGS. 7A and 7B indicate the flow of air.

When, in the state illustrated in FIG. 6, an AC driving voltage corresponding to the frequency (base wave) of the primary vibrating mode of the pump main body is applied to the piezoelectric element 40 from the external terminals 63 and 72, the vibrating plate 39 bends and vibrates in a concentric circle shape. At the same time, in response to a pressure fluctuation in the pump chamber 36 caused by the bending vibration of the vibrating plate 39, the top plate 37 bends and vibrates in a concentric circle shape in accordance with the bending vibration of the vibrating plate 39 (with the vibration phase being delayed by 180° in this embodiment). The vibrating plate 39 and the top plate 37 bend and deform, and the volume of the pump chamber 36 changes periodically as a result, as indicated in FIGS. 7A and 7B.

As indicated in FIG. 7A, when the AC driving voltage is applied to the piezoelectric element 40 and the vibrating plate 39 bends toward the piezoelectric element 40, the volume of the pump chamber 36 increases. As a result, air outside of the first pump 101 is suctioned into the pump chamber 36 through the suction hole 53 and the ventilation channel 31. Furthermore, air outside of the first pump 101 is suctioned into the pump chamber 36 through the suction hole 53, the ventilation channel 31, and the ventilation hole 45. Although air does not flow out from the pump chamber 36, inertia acts on the flow of air from the discharge hole 24 to the exterior of the first pump 101.

As indicated in FIG. 7B, when the AC driving voltage is applied to the piezoelectric element 40 and the vibrating plate 39 bends toward the pump chamber 36, the volume of the pump chamber 36 decreases. As a result, air in the pump chamber 36 is discharged from the discharge hole 24 through the ventilation hole 45 and the ventilation channel 31.

At this time, the air discharged from the pump chamber 36 causes air outside of the first pump 101 to be pulled in through the suction hole 53 and the ventilation channel 31 and discharged from the discharge hole 24. Accordingly, the flow rate of the air discharged from the discharge hole 24 increases by an amount equivalent to the flow rate of the air pulled in from the exterior.

As described thus far, the first pump 101 according to this embodiment greatly increases the discharge flow rate per unit of power consumed. As such, the first pump 101 achieves a high discharge flow rate while at the same time consuming less power.

Next, the structure of the second pump 201 will be described in detail using FIGS. 8, 9, and 10.

Figure 8:
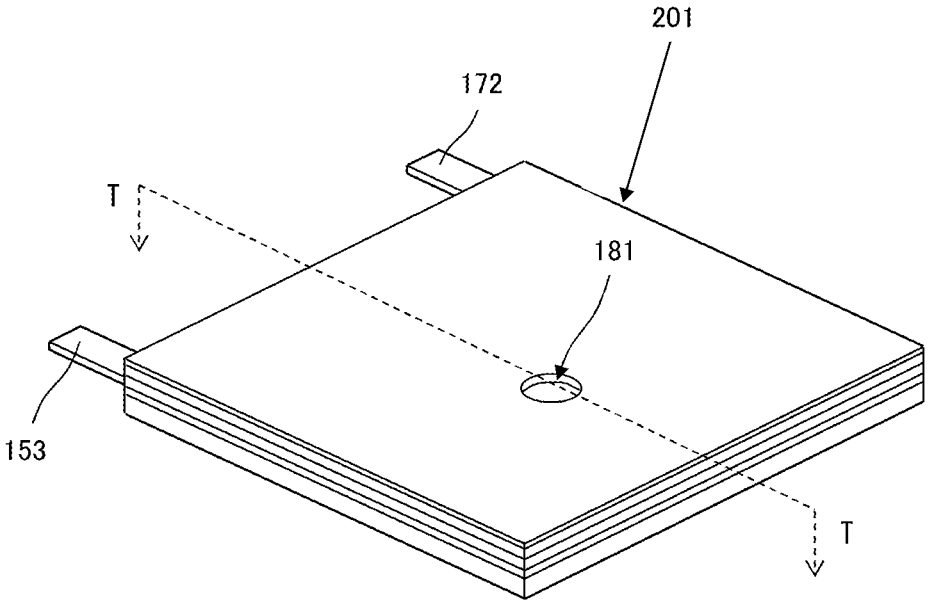
FIG. 8 is an external perspective view of the second pump 201 indicated in FIG. 1.

FIG. 8 is an external perspective view of the second pump 201 indicated in FIG. 1. FIG. 9 is an exploded perspective view of the second pump 201 indicated in FIG. 1. FIG. 10 is a cross-sectional view of the second pump 201 indicated in FIG. 8, taken along a T-T line.

The second pump 201 has a structure in which a cover plate 195, a substrate 191, a flexible plate 151, a spacer 120, a vibrating plate unit 160, a piezoelectric element 142, a spacer 135, an electrode conducting plate 170, a spacer 130, and a lid plate 185 are stacked in that order.

The flexible plate 151, the spacer 120, a frame plate 161, the spacer 135, the electrode conducting plate 170, the spacer 130, and the lid plate 185 constitute a pump housing 180. An interior space of the pump housing 180 corresponds to a pump chamber 145.

A vibrating plate 141 has an upper surface opposing the lid plate 185 and a lower surface opposing the flexible plate 151.

Note that the upper surface of the vibrating plate 141 corresponds to a "first main surface" according to the present disclosure. The lower surface of the vibrating plate 141 corresponds to a "second main surface" according to the present disclosure. The flexible plate 151 corresponds to a "plate" according to the present disclosure. The piezoelectric element 142 corresponds to a "driving body" according to the present disclosure.

The piezoelectric element 142 is fixed to the upper surface of the vibrating plate 141 using an adhesive. The vibrating plate 141 and the piezoelectric element 142 are both circular plates. A circular plate-shaped actuator 140 is constituted by the vibrating plate 141 and the piezoelectric element 142.

Here, the vibrating plate unit 160, including the vibrating plate 141, is formed from a metal material having a higher coefficient of linear expansion than the piezoelectric element 142. Using thermal curing when affixing the vibrating plate 141 and the piezoelectric element 142 makes it possible for a suitable amount of compressive stress, which causes the vibrating plate 141 to bow toward the piezoelectric element 142, to remain in the piezoelectric element 142. This compressive stress makes it possible to prevent the piezoelectric element 142 from breaking.

Preferably, the vibrating plate unit 160 is formed of SUS 430, for example. Meanwhile, preferably, the piezoelectric element 142 is formed from a PZT-based ceramic material, for example. The piezoelectric element 142 has a coefficient of linear expansion of almost 0, whereas SUS 430 has a coefficient of linear expansion of approximately $10.4\times10^{-6}K^{-1}$.

Preferably, the spacer 135 is as thick as or slightly thicker than the piezoelectric element 142.

Figure 9:
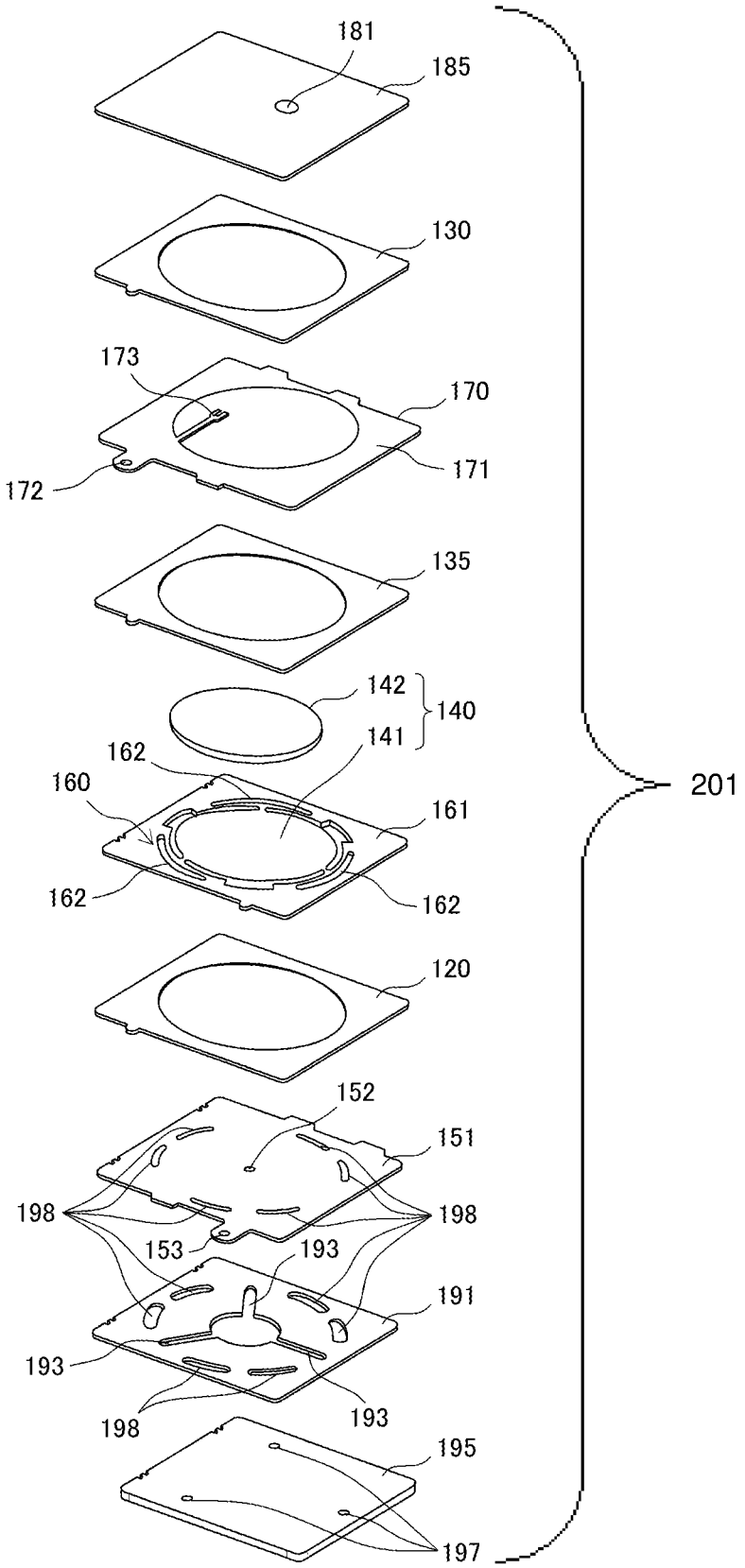
FIG. 9 is an exploded perspective view of the second pump 201 indicated in FIG. 1.

As illustrated in FIG. 9, the vibrating plate 141, the frame plate 161, and connecting portions 162 constitute the vibrating plate unit 160. The vibrating plate unit 160 is formed through integral molding by etching a metal plate. The frame plate 161 is provided in the periphery of the vibrating plate 141. The vibrating plate 141 is connected to the frame plate 161 by the connecting portions 162. The connecting portions 162 have elastic structures, in which the elasticity is provided at a low spring constant. The frame plate 161 is fixed to the flexible plate 151 with the spacer 120 interposed therebetween.

Accordingly, the vibrating plate 141 is elastically supported relative to the frame plate 161 in a flexible manner by the three connecting portions 162. Bending vibration of the vibrating plate 141 is almost uninhibited as a result. In other words, the second pump 201 is structured such that peripheral edge portions (and a center portion, of course) of the actuator 140 are substantially unfixed.

The spacer 135 is fixed to an upper surface of the frame plate 161 using an adhesive. The spacer 135 is formed from a resin. The spacer 135 is as thick as or slightly thicker than the piezoelectric element 142. The spacer 135 also constitutes part of the pump housing 180. In addition, the spacer 135 electrically insulates the electrode conducting plate 170, which will be described next, and the vibrating plate unit 160 from each other.

The electrode conducting plate 170 is fixed to an upper surface of the spacer 135 using an adhesive. The electrode conducting plate 170 is formed from a metal. The electrode conducting plate 170 is constituted by a frame section 171 having a substantially circular opening, an internal terminal 173 that projects into the stated opening, and an external terminal 172 that projects to the exterior.

A tip of the internal terminal 173 is soldered to a surface of the piezoelectric element 142. The internal terminal 173 can be suppressed from vibrating by having the soldering position match the position of a node where the actuator 140 bends and vibrates.

The spacer 130 is bonded to and fixed to an upper surface of the electrode conducting plate 170. The spacer 130 is formed from a resin. The spacer 130 is a spacer for ensuring that the soldered portion of the internal terminal 173 does not make contact with the lid plate 185 when the actuator 140 vibrates. The spacer 130 also suppresses the surface of the piezoelectric element 142 from coming too close to the lid plate 185 and causing a drop in the vibration amplitude due to air resistance. As such, the spacer 130 may have approximately the same thickness as the piezoelectric element 142.

The lid plate 185, in which the discharge hole 181 is formed, is bonded to the upper surface of the spacer 130. The lid plate 185 covers an upper part of the actuator 140. Accordingly, air suctioned through a ventilation hole 152 of the flexible plate 151, which will be described later, is discharged from the discharge hole 181.

Here, the discharge hole 181 is a discharge hole for releasing positive pressure within the pump housing 180 that includes the lid plate 185. It is therefore not absolutely necessary that the discharge hole 181 be provided in the center of the lid plate 185.

An external terminal 153 for making an electrical connection is formed in the flexible plate 151. The ventilation hole 152 is formed in the center of the flexible plate 151. The flexible plate 151 is fixed to the frame plate 161, opposing the lower surface of the vibrating plate 141 with the spacer 120 between the flexible plate 151 and the frame plate 161.

The substrate 191 is affixed to a lower surface of the flexible plate 151 using an adhesive. A cylindrical cavity 192 is formed in the center of the substrate 191. Part of the flexible plate 151 is exposed toward the substrate 191 by the cavity 192 in the substrate 191. The part of the flexible plate 151 exposed in this circular shape can vibrate at substantially the same frequency as the actuator 140 under pressure fluctuations in the air caused by the vibration of the actuator 140.

In other words, the configuration of the flexible plate 151 and the substrate 191 enables the part of the flexible plate 151 that faces the cavity 192 to serve as a circular mobile portion 154 capable of bending and vibrating. The mobile portion 154 corresponds to the center or the vicinity of the center of a region of the flexible plate 151 that opposes the actuator 140. Furthermore, a part of the flexible plate 151 located further outside than the mobile portion 154 serves as a fixed portion 155 that is fixed to the substrate 191. A unique vibration frequency of this mobile portion 154 is designed to be the same as or slightly lower than a driving frequency of the actuator 140.

Accordingly, the mobile portion 154 of the flexible plate 151 also vibrates at a high amplitude central to the ventilation hole 152 in response to the vibration of the actuator 140. When a vibration phase of the flexible plate 151 becomes delayed relative to a vibration phase of the actuator 140 (by 90°, for example), fluctuations in the thickness of a gap space between the flexible plate 151 and the actuator 140 substantially increase. Meanwhile, the fluctuations in the thickness of the gap space can generate motion that sends the air from an inner side portion toward an outer side portion. The second pump 201 can therefore further improve the pumping performance (the discharge pressure and the discharge flow rate).

The cover plate 195 is bonded to a lower part of the substrate 191. The three suction holes 197 are provided in the cover plate 195. The suction holes 197 communicate with the cavity 192 through flow channels 193 formed in the substrate 191.

The flexible plate 151, the substrate 191, and the cover plate 195 are formed from a material having a higher coefficient of linear expansion than the vibrating plate unit 160. The flexible plate 151, the substrate 191, and the cover plate 195 are each formed from a material substantially the same coefficient of linear expansion.

Preferably, the flexible plate 151 is formed from beryllium copper or the like, for example. Preferably, the substrate 191 is formed from phosphor bronze or the like. Preferably, the cover plate 195 is formed from copper or the like. These have coefficients of linear expansion of approximately $17\times10^{-6}K^{-1}$. In addition, preferably, the vibrating plate unit 160 is formed of SUS 430 or the like. The coefficient of linear expansion of SUS 430 is approximately $10.4\times10^{-6}K^{-1}$.

In this case, due to the difference between the coefficient of linear expansion of the frame plate 161 and the coefficient of linear expansion of the flexible plate 151, the substrate 191, and the cover plate 195, using thermal curing during the bonding makes it possible to cause the flexible plate 151 to bow toward the piezoelectric element 142 and impart tension on the mobile portion 154. The tension of the mobile portion 154, which can bend and vibrate, can be adjusted as a result. Furthermore, the mobile portion 154 will not sag and inhibit the vibration of the mobile portion 154.

Note that the beryllium copper of which the flexible plate 151 is formed is a spring material, and thus does not deform by elastic fatigue or the like even if the circular mobile portion 154 vibrates at a high amplitude. In other words, beryllium copper has superior durability.

In the structure described thus far, when an AC driving voltage corresponding to the frequency (base wave) of the primary vibrating mode of the second pump 201 is applied to the external terminals 153 and 172, the actuator 140 of the second pump 201 bends and vibrates in a concentric circle shape. Furthermore, in the second pump 201, the mobile portion 154 of the flexible plate 151 vibrates in accordance with the vibrating plate 141 vibrating.

Through this, the second pump 201 suctions air into the pump chamber 145 from the suction holes 197 through the ventilation hole 152. Furthermore, the second pump 201 discharges air in the pump chamber 145 from the discharge hole 181.

At this time, in the second pump 201, the peripheral edge portion of the vibrating plate 141 is substantially unfixed. As such, the second pump 201 has little loss accompanying the vibration of the vibrating plate 141, and achieves a high discharge pressure while at the same time being small and having a low profile.

Preferably, hole portions 198 are provided in regions, of the flexible plate 151 and the substrate 191, that oppose the connecting portions 162. Through this, excess adhesive flows into the hole portions 198 when the frame plate 161, the spacer 120, and the flexible plate 151 are fixed using the adhesive.

Accordingly, the second pump 201 can suppress the vibrating plate 141 and the connecting portions 162 from bonding to the flexible plate 151. That is, the second pump 201 can suppress the vibration of the vibrating plate 141 from being inhibited by the adhesive.

Operations of the gas control device 100 when filling the receptacle 9 with air will be described next.

Figure 11:
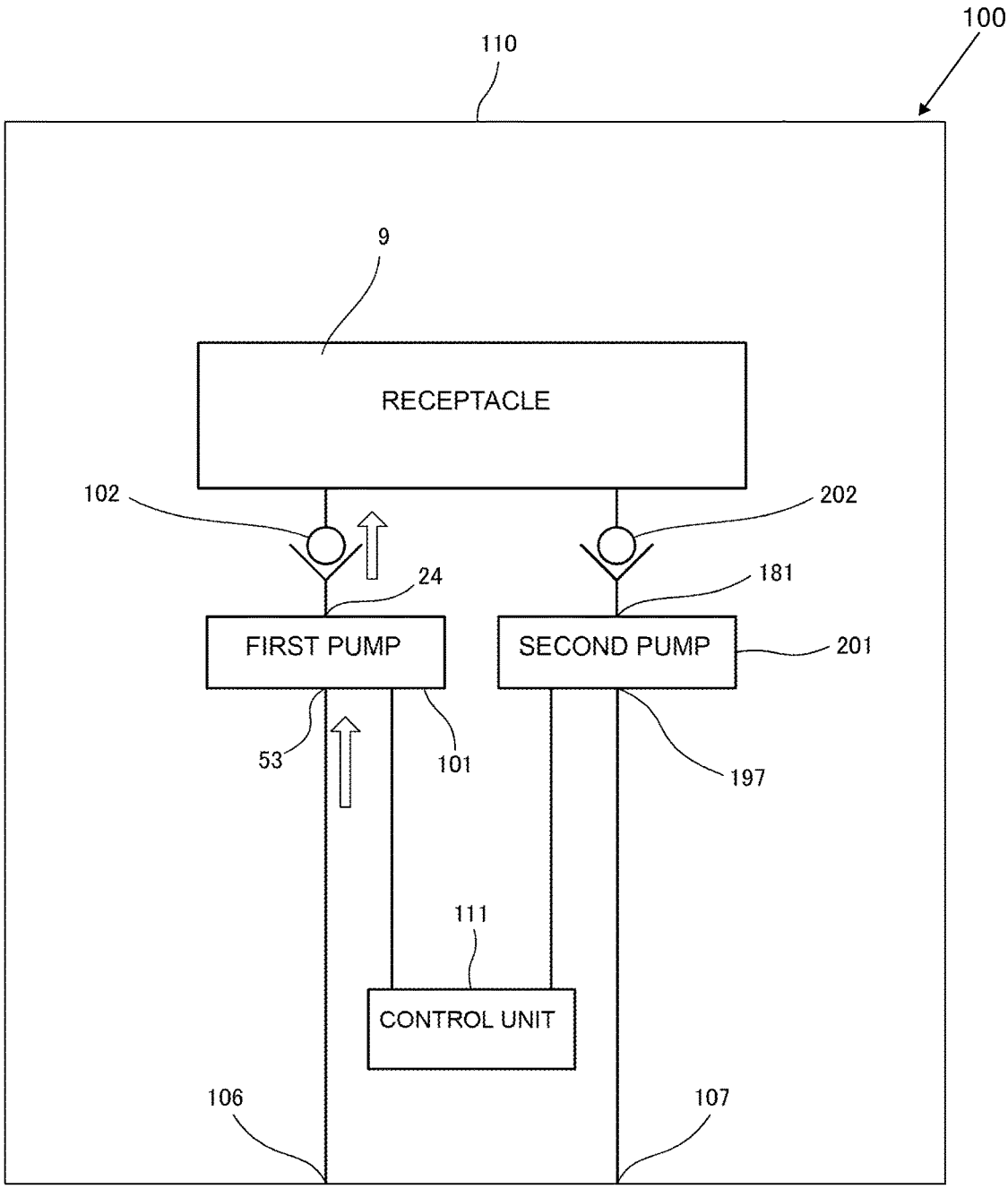
FIG. 11 is a schematic diagram illustrating the flow of air when the first pump 101 indicated in FIG. 1 is being driven.
Figure 12:
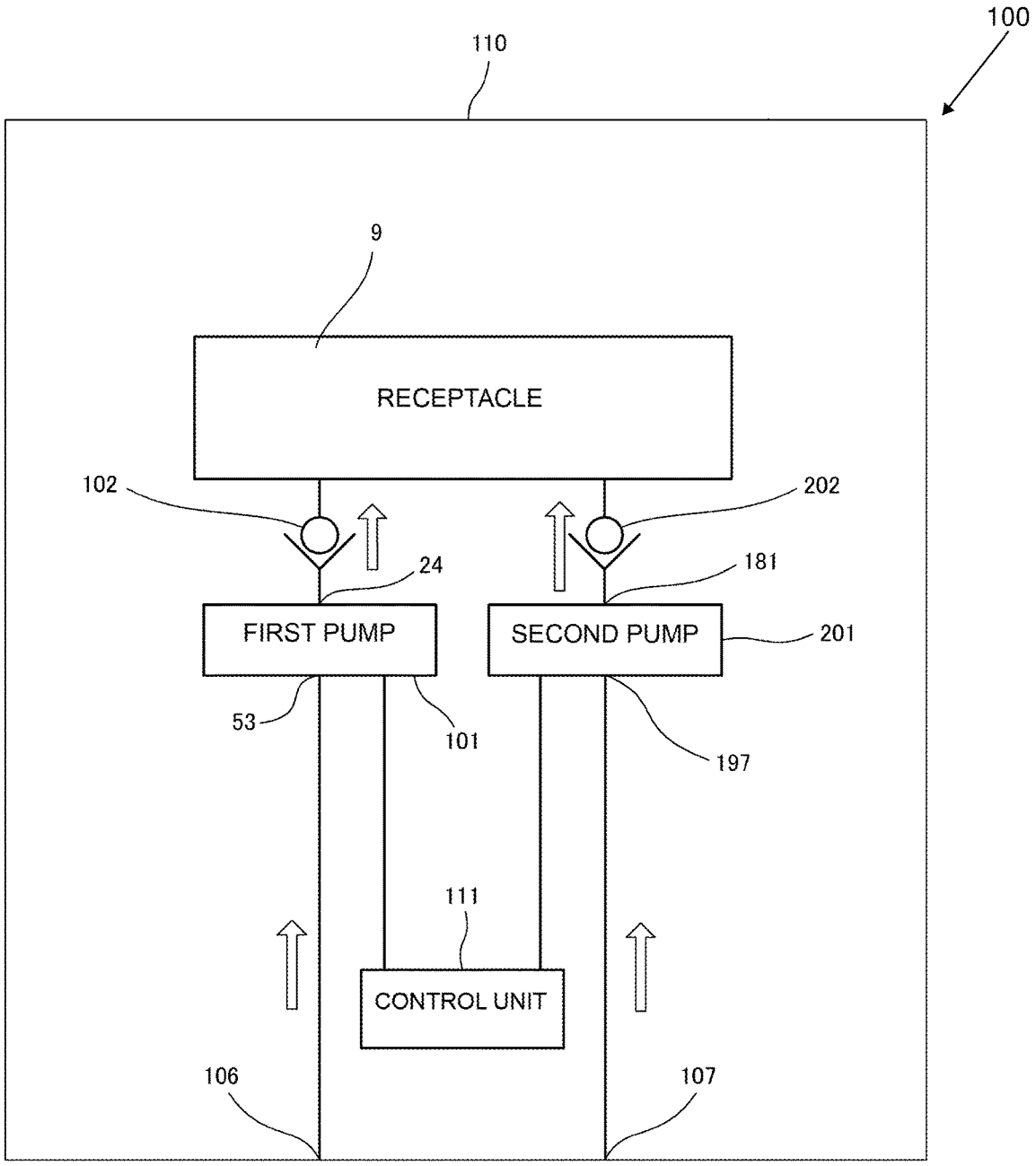
FIG. 12 is a schematic diagram illustrating the flow of air when the first pump 101 and the second pump 201 indicated in FIG. 1 are being driven.

FIG. 11 is a schematic diagram illustrating the flow of air when the first pump 101 indicated in FIG. 1 is being driven. FIG. 12 is a schematic diagram illustrating the flow of air when the first pump 101 and the second pump 201 indicated in FIG. 1 are being driven. The arrows in FIGS. 11 and 12 indicate the flow of air.

When starting to fill the receptacle 9 with air, the control unit 111 applies a driving voltage to the piezoelectric element 40 of the first pump 101 and turns the first pump 101 on. As a result, air outside the housing 110 is suctioned from the ventilation hole 106, traverses the interior of the first pump 101, is discharged into the receptacle 9 from the discharge hole 24 of the first pump 101, and inflates the receptacle 9.

Note that at this time, the second check valve 202 closes in response to the rise in the air pressure in the receptacle 9. As such, using the second check valve 202, the gas control device 100 can prevent the air in the receptacle 9 from flowing back to the discharge hole 181 of the second pump 201.

Once a set amount of time has passed from when the driving of the first pump 101 was started, the control unit 111 applies a driving voltage to the piezoelectric element 142 of the second pump 201 and turns the second pump 201 on.

As a result, air outside the housing 110 is suctioned from the ventilation hole 107, traverses the pump chamber 145 of the second pump 201, and is discharged from the discharge hole 181 of the second pump 201 into the receptacle 9, and the gas control device 100 raises the pressure (air pressure) in the receptacle 9 to a target pressure.

Note that at this time, the air pressure in the receptacle 9 exceeds than the discharge pressure of the first pump 101. However, in the gas control device 100, the first check valve 102 closes when the air pressure in the receptacle 9 exceeds the discharge pressure of the first pump 101. As such, using the first check valve 102, the gas control device 100 can prevent the air in the receptacle 9 from flowing back to the discharge hole 24 of the first pump 101.

Figure 22:
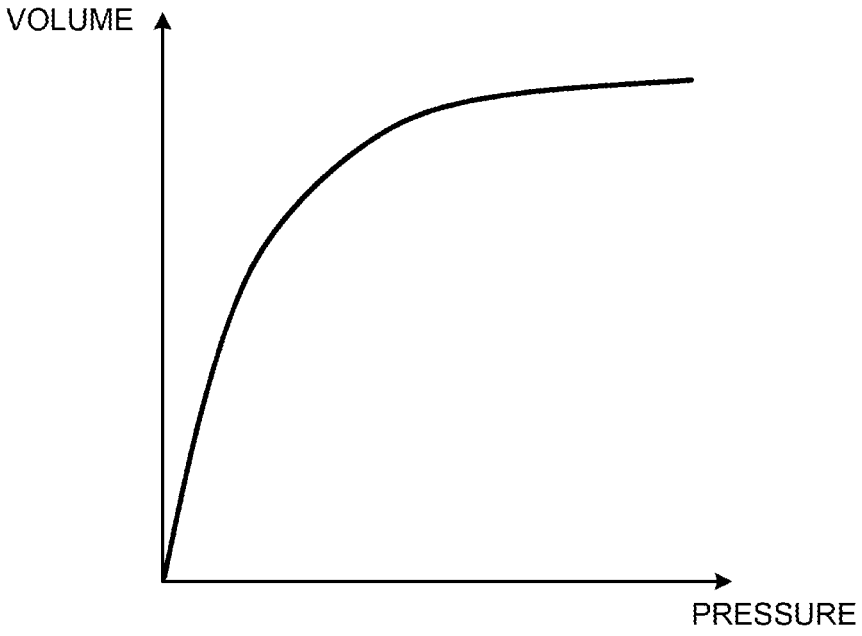
FIG. 22 is a graph illustrating the relationship between the pressure of a gas flowing into a swimming ring and the volume of the swimming ring.
Figure 23:
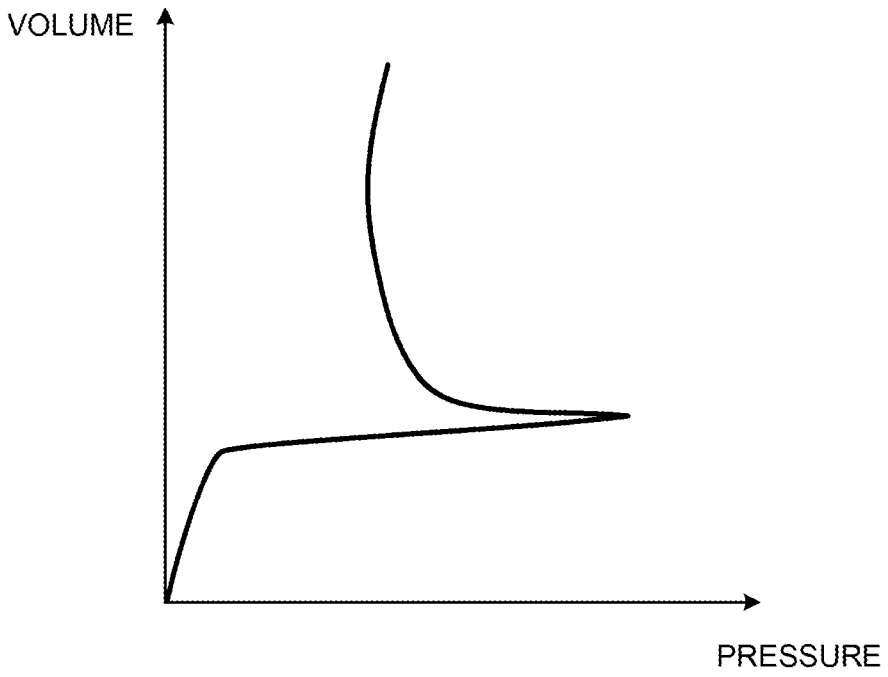
FIG. 23 is a graph illustrating the relationship between the pressure of a gas flowing into a balloon and the volume of the balloon.

Here, a high discharge pressure is not very necessary, but a high discharge flow rate is necessary, during a period from a maximum deflated state, in which the receptacle 9 is not filled with any air at all, to a partially inflated state, in which the receptacle 9 is filled with a certain amount of air, as illustrated in FIG. 22. According to the gas control device 100 of this embodiment, the first pump 101 sends air to the receptacle 9 at a high discharge flow rate until the slack is taken out of the receptacle 9.

Meanwhile, a low discharge flow rate is sufficient, but a high discharge pressure is necessary, during a period from the partially inflated state to a maximum inflated state, where the receptacle 9 is completely filled with air. According to the gas control device 100 of this embodiment, the second pump 201 fills the receptacle 9 with air at a high discharge pressure.

As such, according to the gas control device 100, high flow rate characteristics and high pressure characteristics can be used in accordance with the PQ characteristics required by the receptacle 9, which makes it possible to quickly fill the receptacle 9, which has characteristics in which the volume thereof changes in accordance with the pressure of gas flowing thereinto, with air.

Second Embodiment

Figure 13:
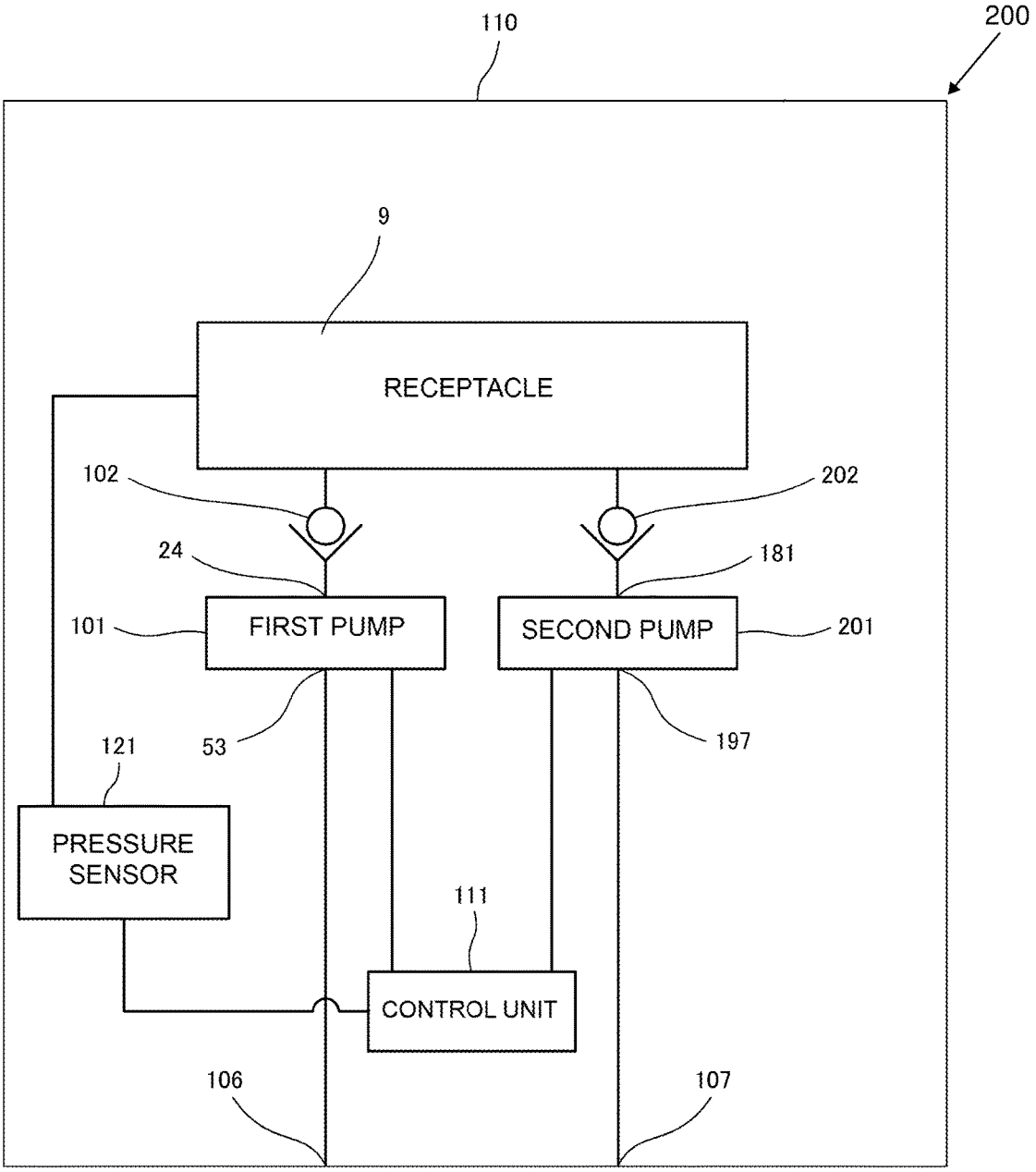
FIG. 13 is a block diagram illustrating the configuration of the primary elements of a gas control device 200 according to a second embodiment of the present disclosure.

FIG. 13 is a block diagram illustrating the configuration of the primary elements of a gas control device 200 according to a second embodiment of the present disclosure. The gas control device 200 differs from the gas control device 100 according to the first embodiment in that the gas control device 200 includes a pressure sensor 121. The rest of the configuration is the same and thus descriptions thereof will be omitted.

To describe in detail, the pressure sensor 121 detects the pressure (air pressure) in the receptacle 9 and outputs a resulting detection signal to the control unit 111.

The control unit 111 monitors the pressure (air pressure) in the receptacle 9 using the detection signal outputted from the pressure sensor 121. The control unit 111 keeps the second pump 201 off from when the driving of the first pump 101 starts to when the air pressure in the receptacle 9 exceeds a set pressure, and turns the second pump 201 on once the air pressure in the receptacle 9 has exceeded the set pressure.

According to the gas control device 200, the control unit 111 turns the second pump 201 on in accordance with the air pressure in the receptacle 9.

As such, the gas control device 200 according to the second embodiment can provide the same effects as the gas control device 100 according to the first embodiment.

Third Embodiment

Figure 14:
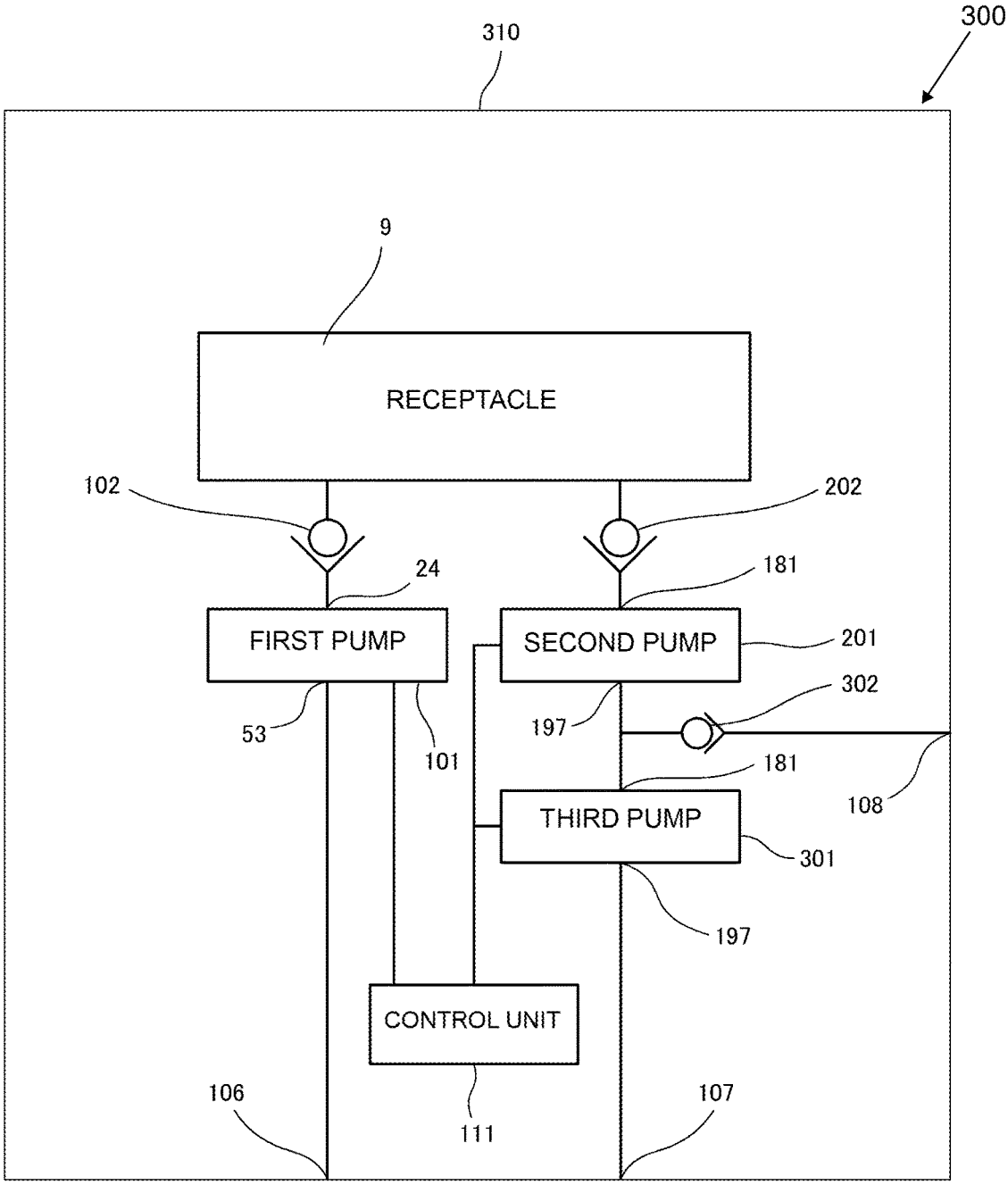
FIG. 14 is a block diagram illustrating the configuration of the primary elements of a gas control device 300 according to a third embodiment of the present disclosure.

FIG. 14 is a block diagram illustrating the configuration of the primary elements of a gas control device 300 according to a third embodiment of the present disclosure. The gas control device 300 differs from the gas control device 100 according to the first embodiment in that the gas control device 300 includes a housing 310, a third pump 301, and a check valve 302. The rest of the configuration is the same and thus descriptions thereof will be omitted.

To describe in detail, the housing 310 of the gas control device 300 is formed from the first ventilation hole 106 that enables the interior and the exterior of the housing 310 to communicate, the second ventilation hole 107 that enables the interior and the exterior of the housing 110 to communicate, and a third ventilation hole 108 that enables the interior and the exterior of the housing 110 to communicate.

The third pump 301 has the same structure as the second pump 201, and has the air suction holes 197 and the air discharge hole 181.

The third pump 301 is a pump having the PQ characteristics indicated in FIG. 3. In other words, like the second pump 201, the third pump 301 is a type of pump having a low discharge flow rate and a high discharge pressure.

A maximum flow rate of air that the first pump 101 is capable of discharging from the discharge hole 24 is greater than a maximum flow rate of air that the third pump 301 is capable of discharging from the discharge hole 181. A maximum pressure of air that the third pump 301 is capable of discharging from the discharge hole 181 is greater than a maximum pressure of air that the first pump 101 is capable of discharging from the discharge hole 24.

In the above-described configuration, the suction hole 53 of the first pump 101 communicates with the first ventilation hole 106. One hole of the check valve 302 communicates with the third ventilation hole 108. The suction holes 197 of the second pump 201 communicate with the discharge hole 181 of the third pump 301 and another hole of the check valve 302.

The suction holes 197 of the third pump 301 communicate with the second ventilation hole 107. The first pump 101 and the second pump 201 are connected in parallel to the receptacle 9 with the first check valve 102 and the second check valve 202 interposed therebetween, respectively, and the discharge hole 24 of the first pump 101 and the discharge hole 181 of the second pump 201 communicate with the interior of the receptacle 9.

Operations of the gas control device 300 when filling the receptacle 9 with air will be described next.

Figure 15:
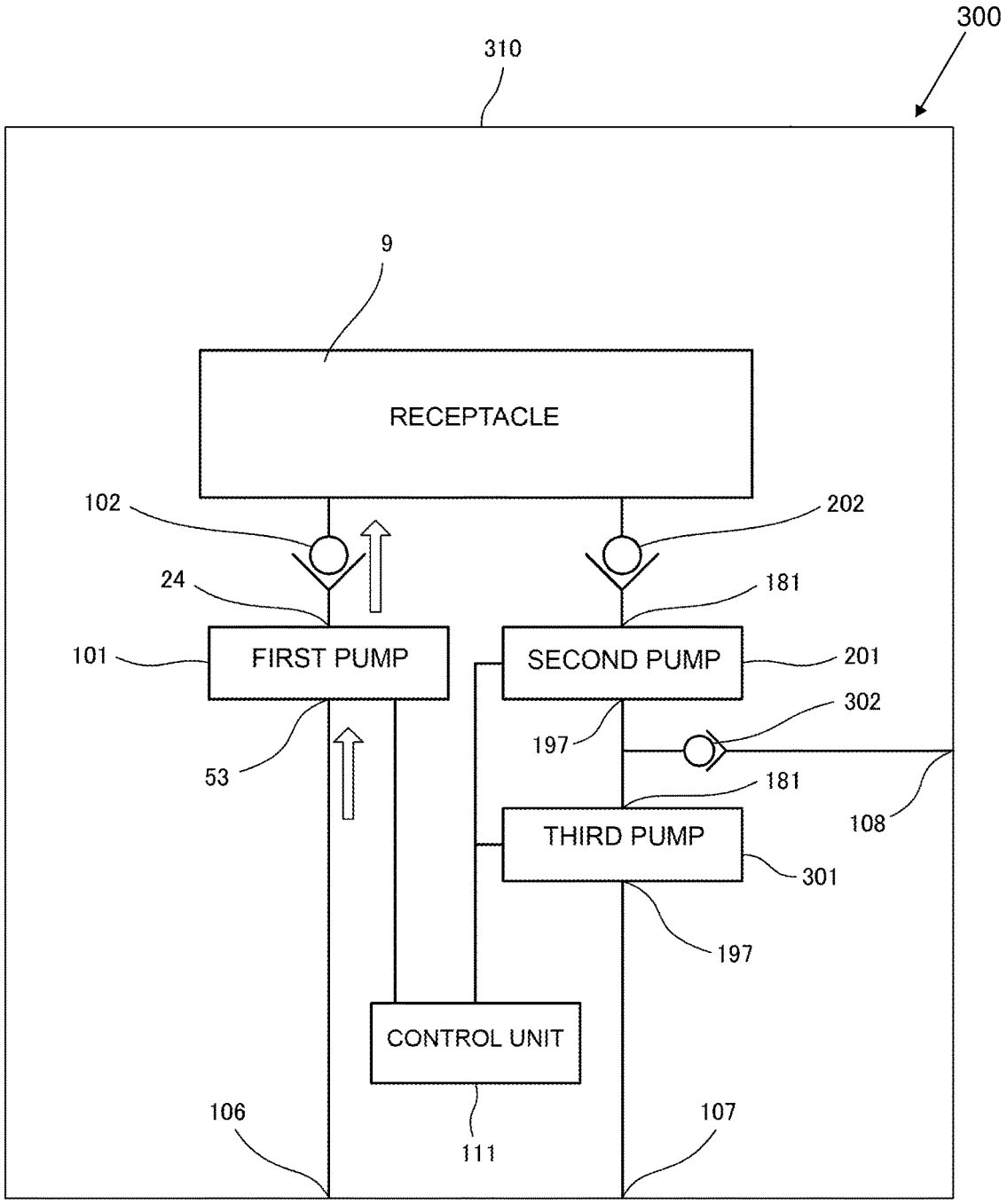
FIG. 15 is a schematic diagram illustrating the flow of air when a first pump 101 indicated in FIG. 14 is being driven.
Figure 16:
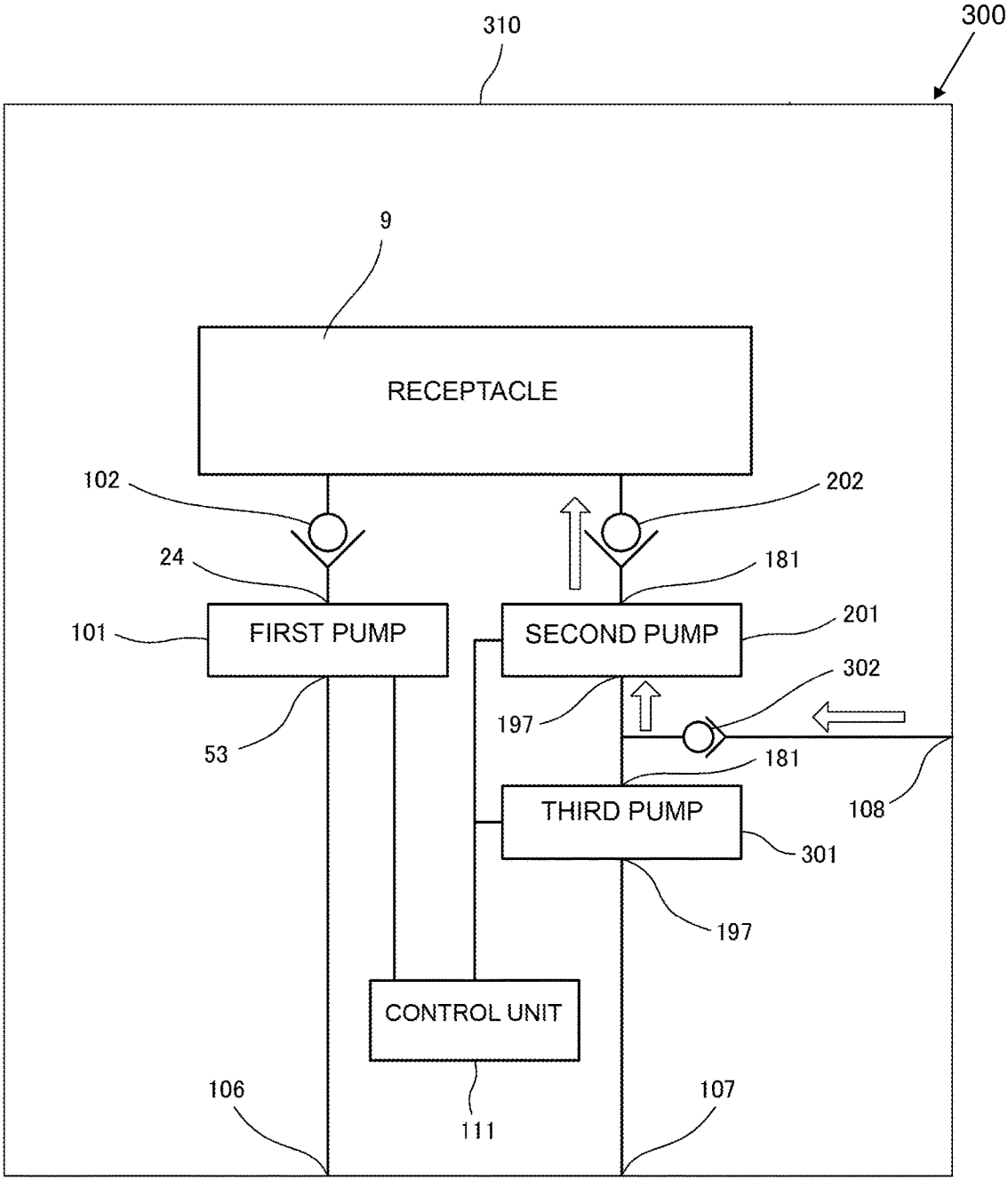
FIG. 16 is a schematic diagram illustrating the flow of air when a second pump 201 indicated in FIG. 14 is being driven.
Figure 17:
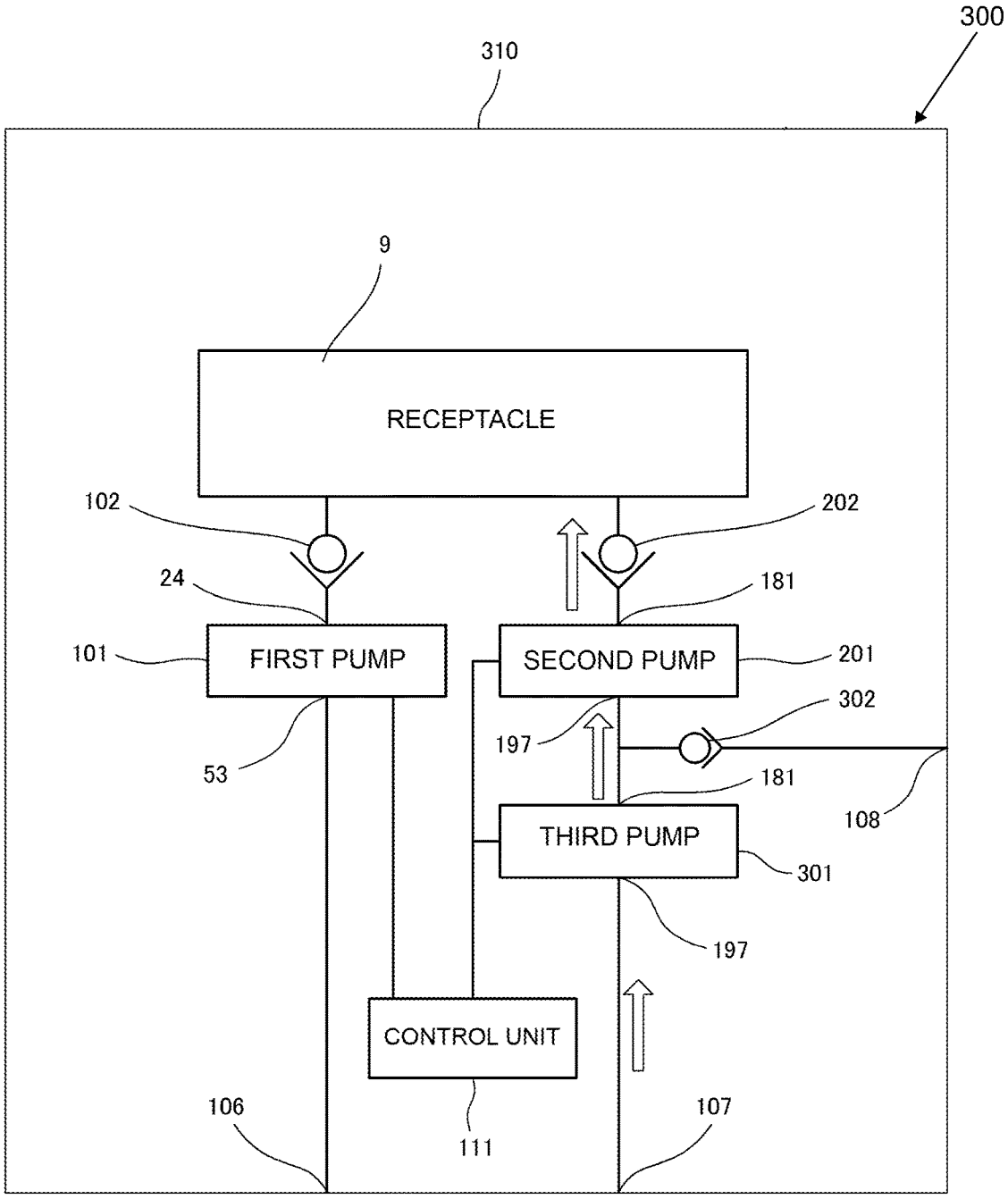
FIG. 17 is a schematic diagram illustrating the flow of air when the second pump 201 and a third pump 301 indicated in FIG. 14 are being driven.

FIG. 15 is a schematic diagram illustrating the flow of air when the first pump 101 indicated in FIG. 14 is being driven. FIG. 16 is a schematic diagram illustrating the flow of air when the second pump 201 indicated in FIG. 14 is being driven. FIG. 17 is a schematic diagram illustrating the flow of air when the second pump 201 and the third pump 301 indicated in FIG. 14 are being driven. The arrows in FIGS. 15 to 17 indicate the flow of air.

When starting to fill the receptacle 9 with air, the control unit 111 applies a driving voltage to the piezoelectric element 40 of the first pump 101 and turns the first pump 101 on. As a result, air outside the housing 310 is suctioned from the ventilation hole 106, traverses the interior of the first pump 101, is discharged into the receptacle 9 from the discharge hole 24 of the first pump 101, and inflates the receptacle 9.

Once a set amount of time has passed from when the driving of the first pump 101 was started, the control unit 111 applies a driving voltage to the piezoelectric element 142 of the second pump 201 and turns the second pump 201 on. The control unit 111 also turns the first pump 101 off.

As a result, air outside the housing 310 is suctioned from the ventilation hole 108, traverses the pump chamber 145 of the second pump 201, and is discharged from the discharge hole 181 of the second pump 201 into the receptacle 9, and the gas control device 300 raises the pressure (air pressure) in the receptacle 9 to a predetermined pressure.

Note that while the second pump 201 is being driven, external air is suctioned through the check valve 302, which has a low flow channel resistance, rather than the third pump 301, which has a high flow channel resistance, up until the pressure (air pressure) in the receptacle 9 reaches the predetermined pressure, and thus a sufficient flow rate is achieved.

It is therefore only necessary to drive the second pump 201, rather than driving both the second pump 201 and the third pump 301, up until the pressure (air pressure) in the receptacle 9 reaches the predetermined pressure. As such, according to the gas control device 300, providing the check valve 302 makes it possible to reduce the amount of power consumed up until the pressure (air pressure) in the receptacle 9 reaches the predetermined pressure.

Meanwhile, at this time, the first check valve 102 closes in response to the rise in the air pressure in the receptacle 9. As such, using the first check valve 102, the gas control device 300 can prevent the air in the receptacle 9 from flowing back to the discharge hole 24 of the first pump 101.

Once a predetermined amount of time has passed from when the driving of the second pump 201 was started, the control unit 111 applies a driving voltage to the piezoelectric element 142 of the third pump 301 and turns the third pump 301 on.

As a result, air outside the housing 310 is suctioned from the ventilation hole 107, traverses the pump chamber 145 of the third pump 301, is discharged from the discharge hole 181 of the third pump 301 to the suction holes 197 of the second pump 201, traverses the pump chamber 145 of the second pump 201, and is discharged to the receptacle 9 from the discharge hole 181 of the second pump 201; the gas control device 300 raises the pressure (air pressure) in the receptacle 9 to a target pressure. Note that the check valve 302 is kept closed at this time to increase the discharge pressure of the third pump 301.

Like the gas control device 100, according to the gas control device 300 of this embodiment, the first pump 101 sends air to the receptacle 9 at a high discharge flow rate until the slack is taken out of the receptacle 9.

According to the gas control device 300 as well, the second pump 201 fills the receptacle 9 with air at a high discharge pressure.

Furthermore, according to the gas control device 300, the second pump 201 and the third pump 301 fill the receptacle 9 with air at a higher discharge pressure. The second pump 201 and the third pump 301, which have the same structure, are connected in series in the gas control device 300. The maximum discharge pressure of the air discharged from the second pump 201 while the second pump 201 and the third pump 301 are being driven therefore reaches twice the maximum discharge pressure of the air discharged from the second pump 201 while the second pump 201 is being driven.

As such, like the gas control device 100, according to the gas control device 300, high flow rate characteristics and high pressure characteristics can be used in accordance with the PQ characteristics required by the receptacle 9, which makes it possible to quickly fill the receptacle 9, which has characteristics in which the volume thereof changes in accordance with the pressure of gas flowing thereinto, with air.

Although the third pump 301 has the same structure as the second pump 201 in this embodiment, the structures are not limited thereto. In practice, the third pump 301 may have a different structure from the second pump 201.

Fourth Embodiment

Figure 18:
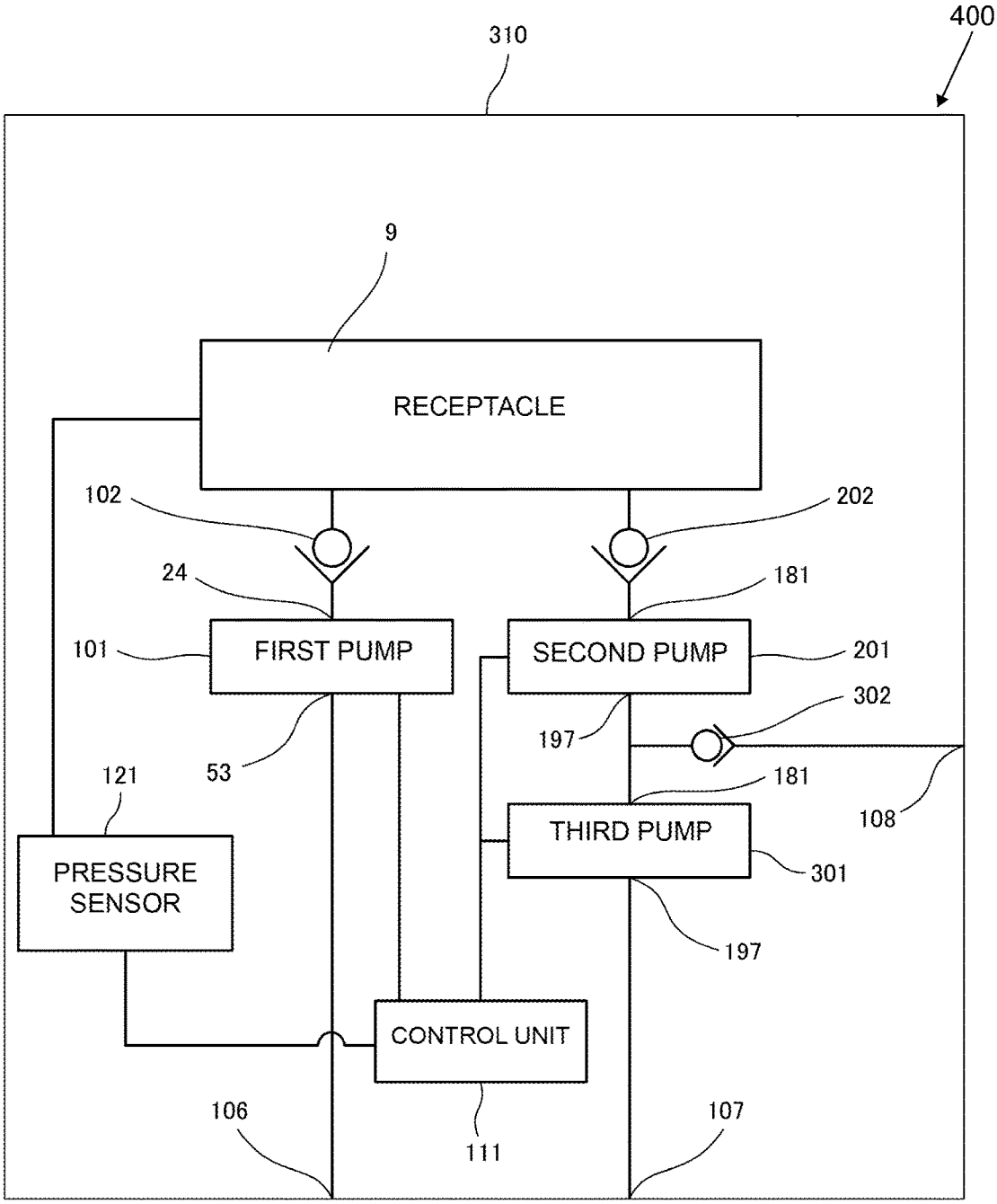
FIG. 18 is a block diagram illustrating the configuration of the primary elements of a gas control device 400 according to a fourth embodiment of the present disclosure.

FIG. 18 is a block diagram illustrating the configuration of the primary elements of a gas control device 400 according to a fourth embodiment of the present disclosure. The gas control device 400 differs from the gas control device 300 according to the third embodiment in that the gas control device 400 includes the pressure sensor 121. The rest of the configuration is the same and thus descriptions thereof will be omitted.

To describe in detail, the control unit 111 monitors the pressure (air pressure) in the receptacle 9 using the detection signal outputted from the pressure sensor 121. The control unit 111 keeps the second pump 201 and the third pump 301 off from when the driving of the first pump 101 starts to when the air pressure in the receptacle 9 exceeds a set pressure, and turns the second pump 201 on once the air pressure in the receptacle 9 has exceeded the set pressure. The control unit 111 then turns the third pump 301 on once the air pressure in the receptacle 9 exceeds a predetermined pressure that is higher than the set pressure.

Like the gas control device 200, according to the gas control device 400, the control unit 111 turns the second pump 201 and the third pump 301 on in accordance with the air pressure in the receptacle 9.

As such, the gas control device 400 according to the fourth embodiment can provide the same effects as the gas control device 300 according to the third embodiment.

Fifth Embodiment

Figure 19:
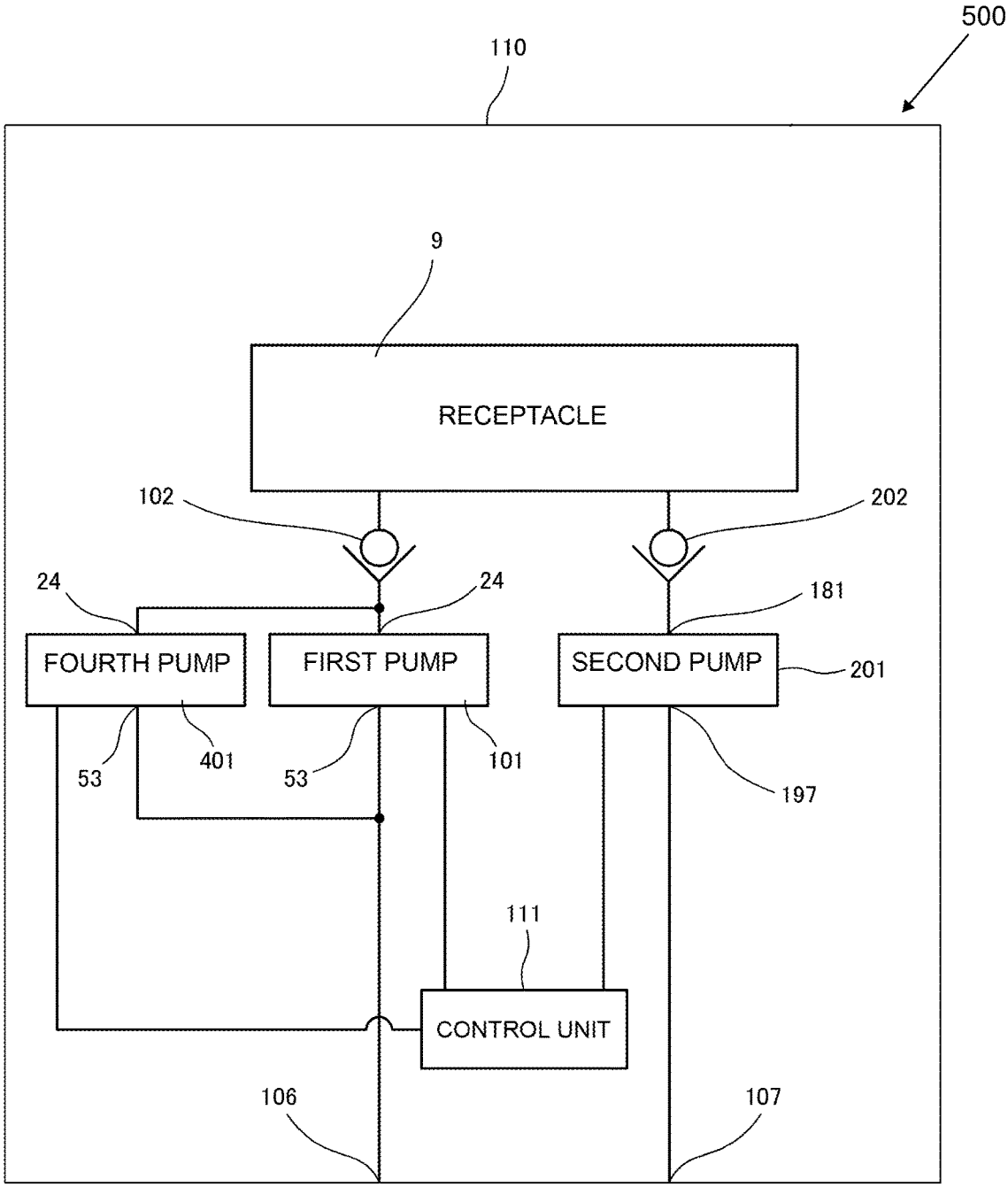
FIG. 19 is a block diagram illustrating the configuration of the primary elements of a gas control device 500 according to a fifth embodiment of the present disclosure.

FIG. 19 is a block diagram illustrating the configuration of the primary elements of a gas control device 500 according to a fifth embodiment of the present disclosure. The gas control device 500 differs from the gas control device 100 according to the first embodiment in that the gas control device 500 includes a fourth pump 401. The rest of the configuration is the same and thus descriptions thereof will be omitted.

To describe in detail, the fourth pump 401 has the same structure as the first pump 101, and has the air suction hole 53 and the air discharge hole 24.

The fourth pump 401 is a pump having the PQ characteristics indicated in FIG. 2. In other words, the fourth pump 401 is, like the first pump 101, a type of pump having a high discharge flow rate and a low discharge pressure.

A maximum flow rate of air that the fourth pump 401 is capable of discharging from the discharge hole 24 is greater than a maximum flow rate of air that the second pump 201 is capable of discharging from the discharge hole 181. A maximum pressure of air that the second pump 201 is capable of discharging from the discharge hole 181 is greater than a maximum pressure of air that the fourth pump 401 is capable of discharging from the discharge hole 24.

In the above-described configuration, the suction hole 53 of the first pump 101 communicates with the first ventilation hole 106. The suction hole 53 of the fourth pump 401 communicates with the first ventilation hole 106. The suction holes 197 of the second pump 201 communicate with the second ventilation hole 107. The first pump 101, the fourth pump 401, and the second pump 201 are connected in parallel to the receptacle 9 with the first check valve 102 and the second check valve 202 interposed therebetween, and the discharge hole 24 of the first pump 101, the discharge hole 181 of the second pump 201, and the discharge hole 24 of the fourth pump 401 communicate with the interior of the receptacle 9.

Operations of the gas control device 500 when filling the receptacle 9 with air will be described next.

Figure 20:
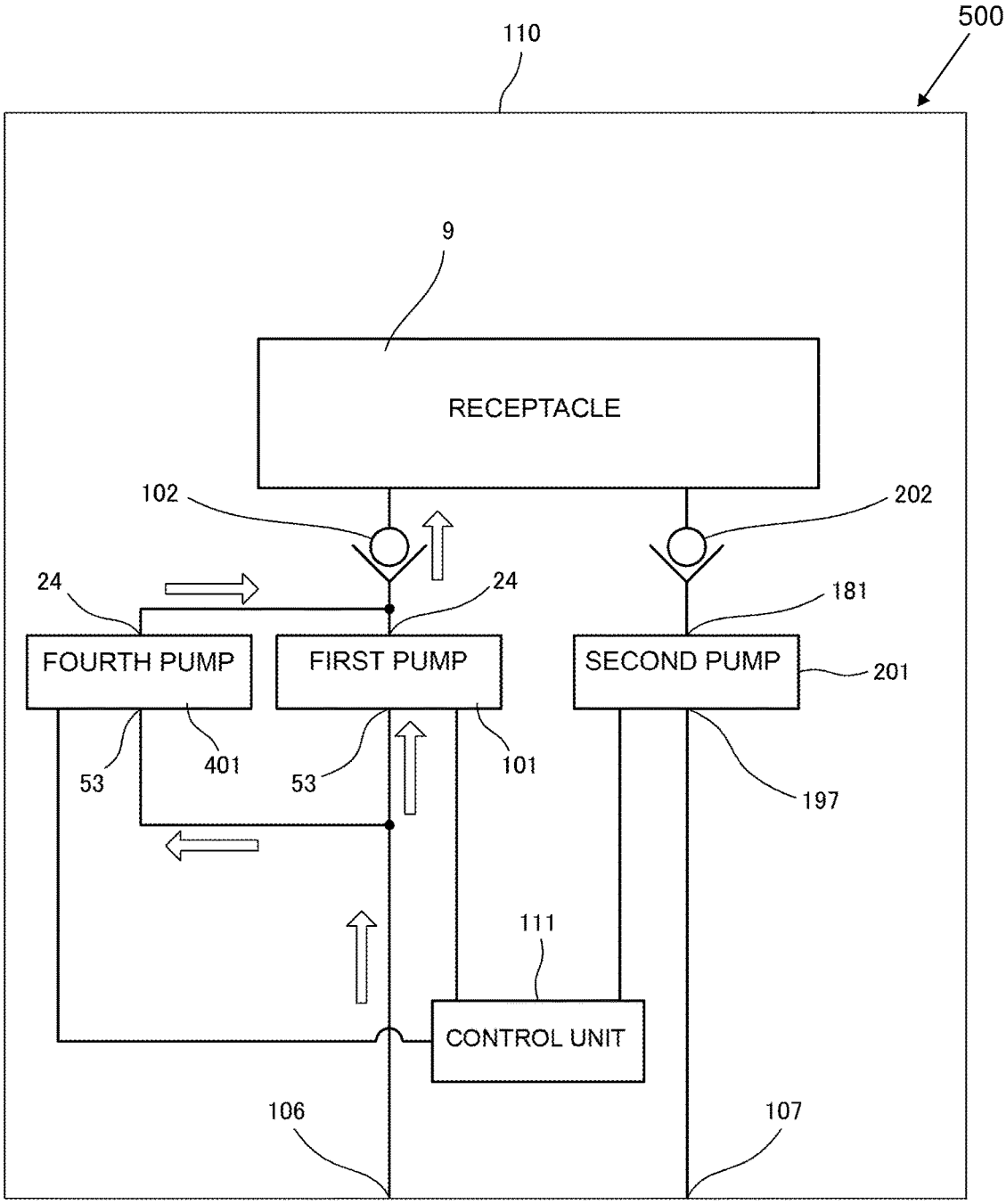
FIG. 20 is a schematic diagram illustrating the flow of air when a first pump 101 and a fourth pump 401 indicated in FIG. 19 are being driven.
Figure 21:
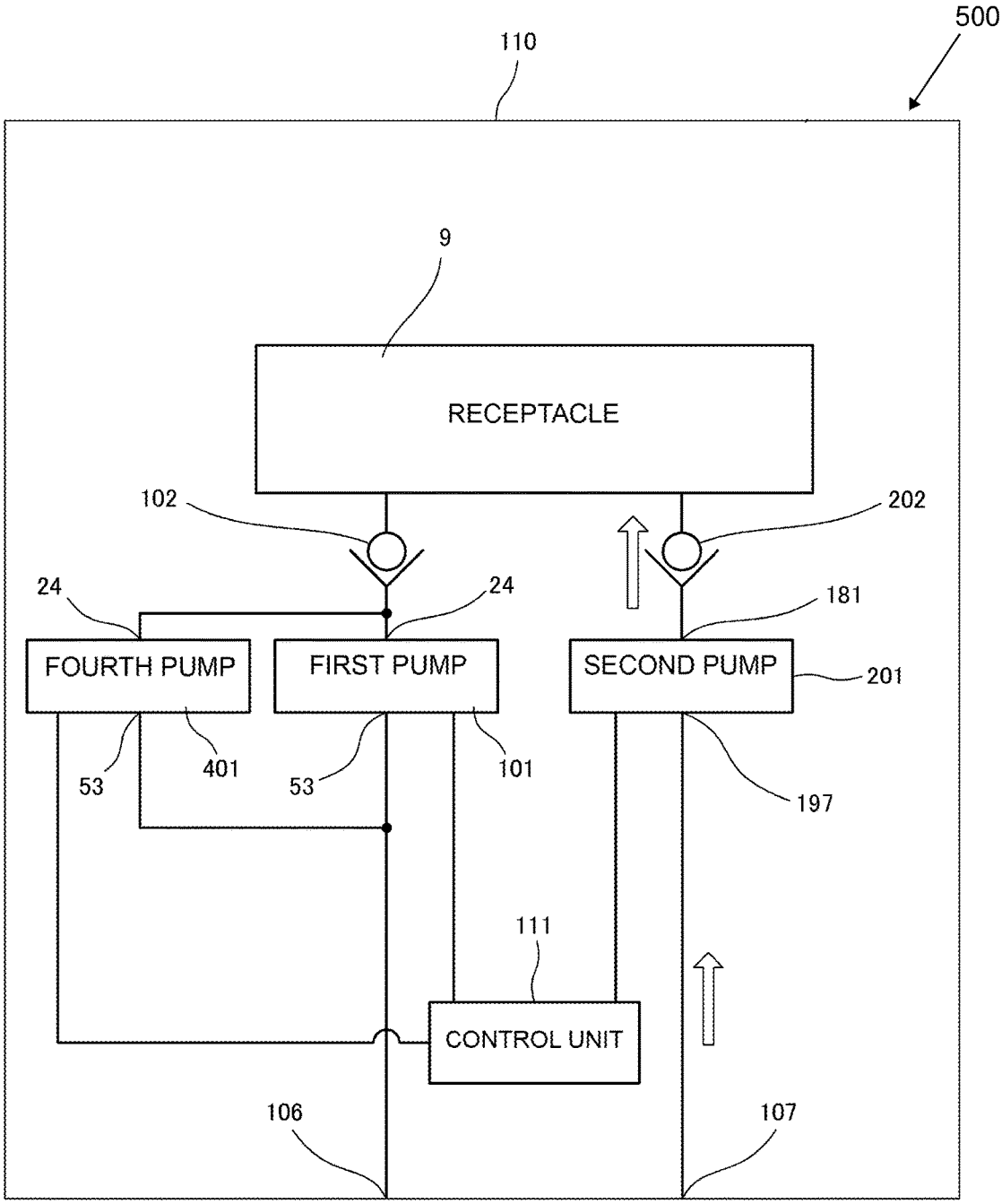
FIG. 21 is a schematic diagram illustrating the flow of air when a second pump 201 indicated in FIG. 19 is being driven.

FIG. 20 is a schematic diagram illustrating the flow of air when the first pump 101 and the fourth pump 401 indicated in FIG. 19 are being driven. FIG. 21 is a schematic diagram illustrating the flow of air when the second pump 201 indicated in FIG. 19 is being driven. The arrows in FIGS. 20 and 21 indicate the flow of air.

When starting to fill the receptacle 9 with air, the control unit 111 applies a driving voltage to the piezoelectric element 40 of the first pump 101 and turns the first pump 101 on. The control unit 111 also applies a driving voltage to the piezoelectric element 40 of the fourth pump 401 and turns the fourth pump 401 on. As a result, air outside the housing 110 is suctioned from the ventilation hole 106, traverses the interior of the first pump 101 and the fourth pump 401, is discharged into the receptacle 9 from the discharge hole 24 of the first pump 101 and the discharge hole 24 of the fourth pump 401, and inflates the receptacle 9.

Once a set amount of time has passed from when the driving of the first pump 101 was started, the control unit 111 applies a driving voltage to the piezoelectric element 142 of the second pump 201 and turns the second pump 201 on. The control unit 111 also turns the first pump 101 and the fourth pump 401 off.

As a result, air outside the housing 110 is suctioned from the ventilation hole 107, traverses the pump chamber 145 of the second pump 201, and is discharged from the discharge hole 181 of the second pump 201 into the receptacle 9, and the gas control device 500 raises the pressure (air pressure) in the receptacle 9 to a target pressure.

Note that at this time, the first check valve 102 closes in response to the rise in the air pressure in the receptacle 9. As such, using the first check valve 102, the gas control device 500 can prevent the air in the receptacle 9 from flowing back to the discharge holes 24 of the first pump 101 and the fourth pump 401.

Like the gas control device 100, according to the gas control device 500 of this embodiment, the first pump 101 sends air to the receptacle 9 at a high discharge flow rate until the slack is taken out of the receptacle 9. The first pump 101 and the fourth pump 401, which have the same structure, are connected in parallel in the gas control device 500. Accordingly, the maximum discharge flow rate of the air discharged from the first pump 101 and the fourth pump 401 reaches twice the maximum discharge flow rate of the air discharged from the first pump 101 alone.

According to the gas control device 500 as well, the second pump 201 fills the receptacle 9 with air at a high discharge pressure.

As such, like the gas control device 100, according to the gas control device 500, high flow rate characteristics and high pressure characteristics can be used in accordance with the PQ characteristics required by the receptacle 9, which makes it possible to quickly fill the receptacle 9, which has characteristics in which the volume thereof changes in accordance with the pressure of gas flowing thereinto, with air.

Although the fourth pump 401 has the same structure as the first pump 101 in this embodiment, the structures are not limited thereto. In practice, the fourth pump 401 may have a different structure from the first pump 101.

Meanwhile, the pressure sensor 121 may be provided in the gas control device 500 as well, in the same manner as the gas control device 200 illustrated in FIG. 13. Like the gas control device 200, according to the gas control device 500, the control unit 111 may turn the first pump 101, the fourth pump 401, and the second pump 201 on in order accordance with the air pressure in the receptacle 9.

Meanwhile, the third pump 301 may be connected in series to the second pump 201 and the check valve 302 may be provided in the gas control device 500 as well, in the same manner as the gas control device 300 illustrated in FIG. 14.

Incidentally, although the above-described embodiments describe filling the receptacle with a gas discharged from the pumps, the embodiments are not limited thereto. The same configurations are possible even in the case of suctioning a gas from the receptacle using the pumps.

Sixth Embodiment of the Present Disclosure

A gas control device 600 according to a sixth embodiment of the present disclosure will be described hereinafter using FIGS. 24, 2, and 3.

Figure 24:
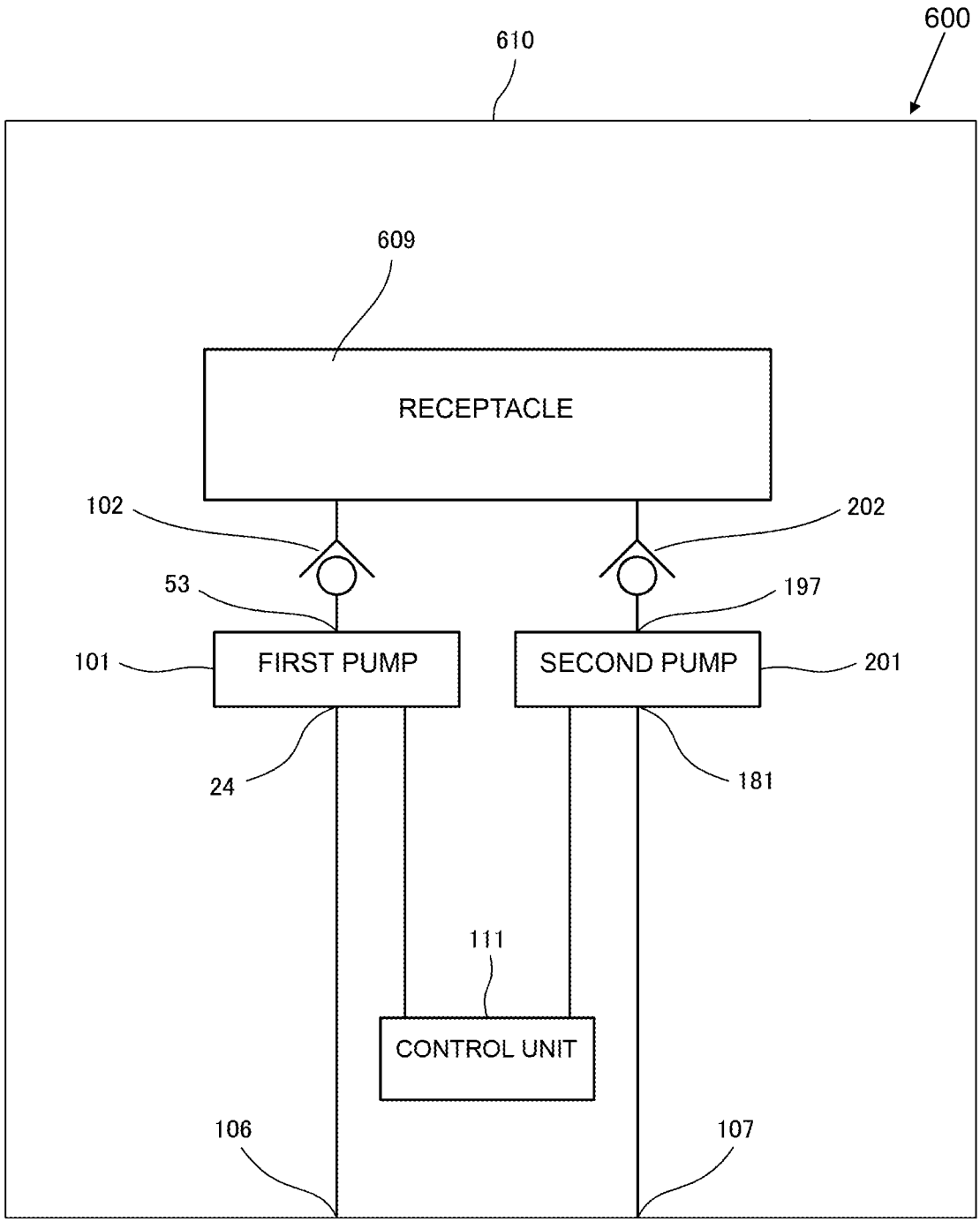
FIG. 24 is a block diagram illustrating the configuration of the primary elements of a gas control device 600 according to a sixth embodiment of the present disclosure.

FIG. 24 is a block diagram illustrating the configuration of the primary elements of the gas control device 600 according to the sixth embodiment of the present disclosure. The main differences between the gas control device 600 and the gas control device 100 according to the first embodiment are that the first pump 101, the second pump 201, the first check valve 102, and the second check valve 202 are connected in the reverse direction, and that a receptacle 609 is provided. The rest of the configuration is the same and thus descriptions thereof will be omitted.

The gas control device 600 includes the first pump 101, the second pump 201, the first check valve 102, the second check valve 202, and the flexible receptacle 609.

Note that the first check valve 102 corresponds to a third check valve according to the present disclosure. The second check valve 202 corresponds to a fourth check valve according to the present disclosure.

The receptacle 609 has characteristics in which the volume thereof changes in accordance with the pressure of air flowing thereinto. The gas control device 600 is, for example, a cupping device that is used when pressing a solid hemispherical cup against the skin. The cup and the skin constitute the receptacle 609. Although the cup is solid, the skin is suctioned up and bulges under the suction pressure within the cup, which substantially reduces the volume within the cup; as such, the volume of a space formed by the cup and the skin changes in accordance with the pressure.

Alternatively, the gas control device 600 is a packing device that wraps an item of food, clothing, or the like in the flexible receptacle 609, suctions a gas within the receptacle 609, and compresses the wrapped item to a small size using a pressure difference from the outside atmospheric pressure.

A housing 610 of the gas control device 600 is formed from the first ventilation hole 106 that enables the interior and the exterior of the housing 610 to communicate, and the second ventilation hole 107 that enables the interior and the exterior of the housing 610 to communicate.

The first pump 101 has the air suction hole 53 and the air discharge hole 24. The second pump 201 has air suction holes 197 and an air discharge hole 181.

The first pump 101 is a pump having the PQ characteristics indicated in FIG. 2. In other words, the first pump 101 is a type of pump having a high discharge flow rate and a low discharge pressure. The second pump 201 is a pump having the PQ characteristics indicated in FIG. 3. In other words, the second pump 201 is a type of pump having a low discharge flow rate and a high discharge pressure.

The maximum flow rate of air that can be suctioned from the suction hole 53 by the first pump 101 is greater than the maximum flow rate of air that can be suctioned from the suction holes 197 by the second pump 201. The maximum suction pressure of air that can be suctioned from the suction holes 197 by the second pump 201 is greater than the maximum suction pressure of air that can be suctioned from the suction hole 53 by the first pump 101.

Here, the discharge hole 24 of the first pump 101 communicates with the first ventilation hole 106. The discharge hole 181 of the second pump 201 communicates with the second ventilation hole 107. The first pump 101 and the second pump 201 are connected in parallel to the receptacle 609 with the first check valve 102 and the second check valve 202 interposed therebetween. The suction hole 53 of the first pump 101 therefore communicates with the interior of the receptacle 609. Likewise, the suction holes 197 of the second pump 201 communicate with the interior of the receptacle 609.

The first check valve 102 prevents air from flowing from the suction hole 53 into the receptacle 609. The second check valve 202 prevents air from flowing from the suction holes 197 into the receptacle 609.

The control unit 111 is constituted of a microcomputer, for example, and controls the operations of the various elements in the gas control device 600. The control unit 111 includes a timer circuit that measures time.

Operations of the gas control device 600 when suctioning air from the receptacle 609 will be described next.

Figure 25:
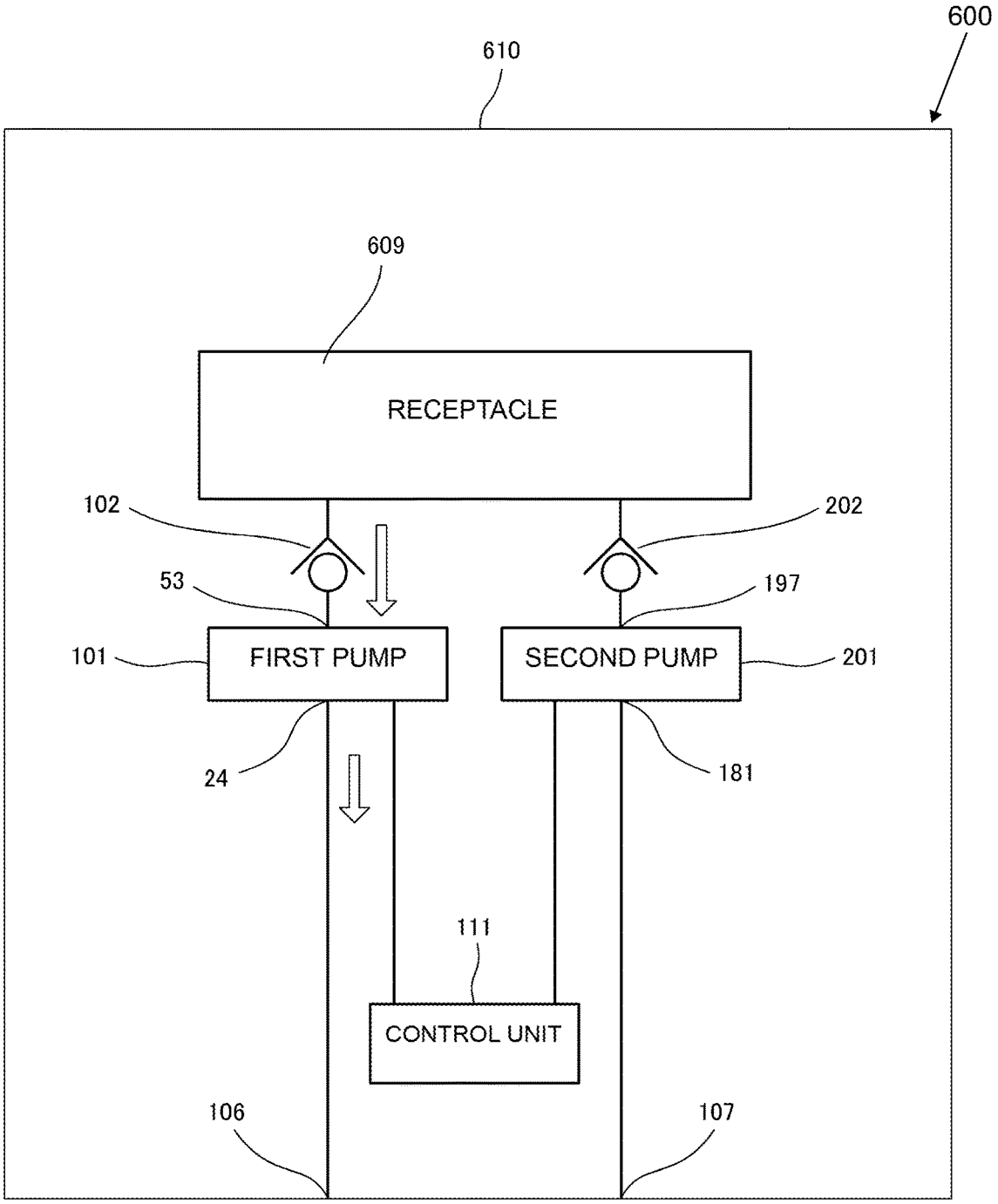
FIG. 25 is a schematic diagram illustrating the flow of air when a first pump 101 indicated in FIG. 24 is being driven.
Figure 26:
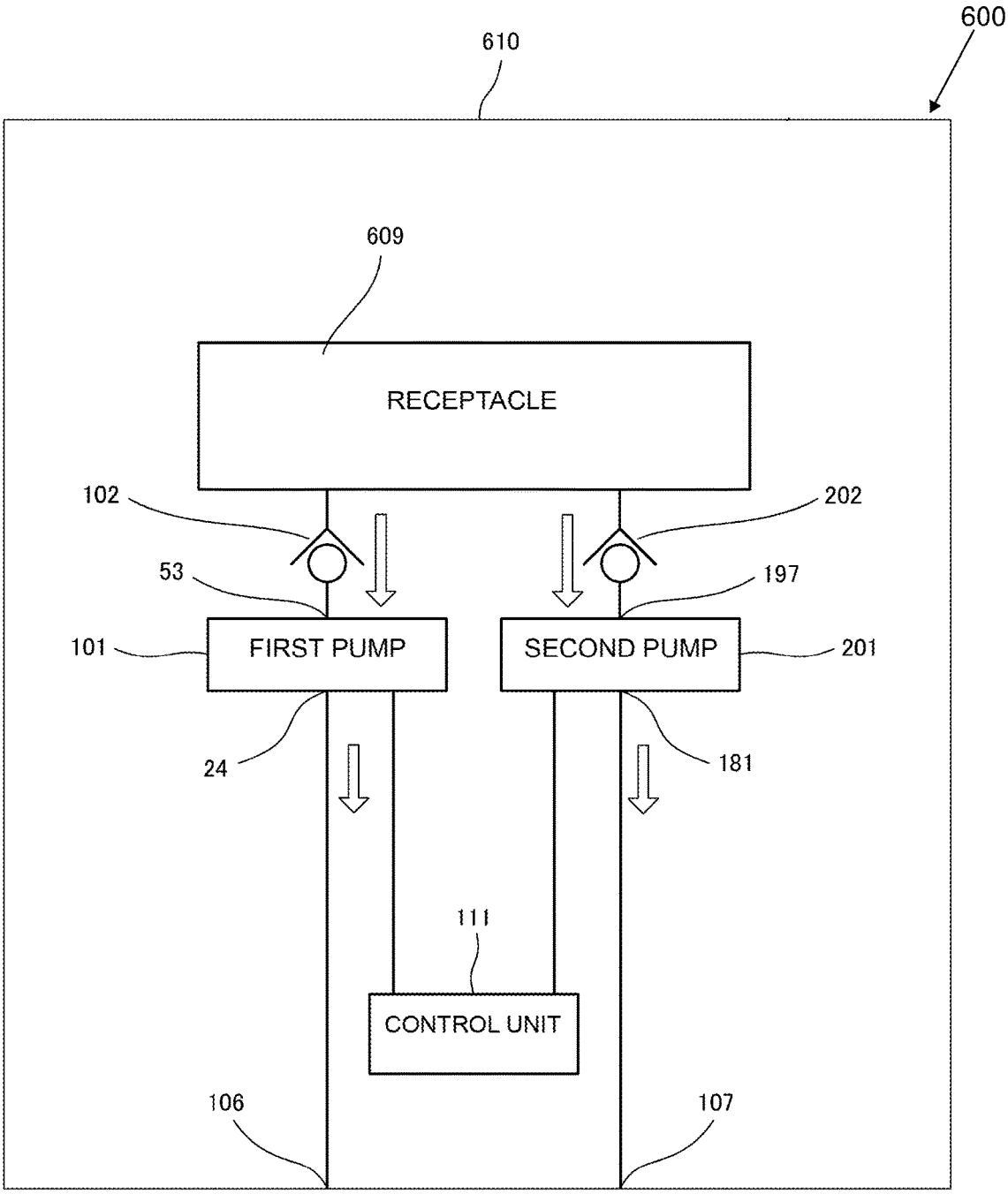
FIG. 26 is a schematic diagram illustrating the flow of air when the first pump 101 and a second pump 201 indicated in FIG. 24 are being driven.

FIG. 25 is a schematic diagram illustrating the flow of air when the first pump 101 indicated in FIG. 24 is being driven. FIG. 26 is a schematic diagram illustrating the flow of air when the first pump 101 and the second pump 201 indicated in FIG. 24 are being driven. The arrows in FIGS. 25 and 26 indicate the flow of air.

When starting to suction the air from the receptacle 609, the control unit 111 applies a driving voltage to the piezoelectric element 40 of the first pump 101 and turns the first pump 101 on. As a result, the air in the receptacle 609 is suctioned from the suction hole 53, traverses the interior of the first pump 101, and is discharged to the exterior of the housing 610 from the discharge hole 24 of the first pump 101 through the ventilation hole 106, causing the receptacle 609 to contract.

Note that at this time, the second check valve 202 closes in response to the drop in the air pressure in the receptacle 609. As such, using the second check valve 202, the gas control device 600 can prevent air from flowing black into the receptacle 609 from the suction holes 197 of the second pump 201.

Once a set amount of time has passed from when the driving of the first pump 101 was started, the control unit 111 applies a driving voltage to the piezoelectric element 142 of the second pump 201 and turns the second pump 201 on.

As a result, the air in the receptacle 609 is suctioned from the suction holes 197, traverses the interior of the second pump 201, and is discharged to the exterior of the housing 610 from the discharge hole 181 of the second pump 201 through the ventilation hole 107. The gas control device 600 reduces the pressure (air pressure) in the receptacle 609 to a target pressure as a result.

Note that at this time, the air pressure in the receptacle 609 drops below the suction pressure of the first pump 101. However, in the gas control device 600, the first check valve 102 closes when the air pressure in the receptacle 609 drops below the suction pressure of the first pump 101. As such, using the first check valve 102, the gas control device 600 can prevent air from flowing black into the receptacle 609 from the suction hole 53 of the first pump 101.

As such, according to the gas control device 600, high flow rate characteristics and high pressure characteristics can be used in accordance with the PQ characteristics required by the receptacle 609, which makes it possible to quickly suction air from the receptacle 609, which has characteristics in which the volume thereof changes in accordance with the pressure of gas remaining therein.

Seventh Embodiment

Figure 27:
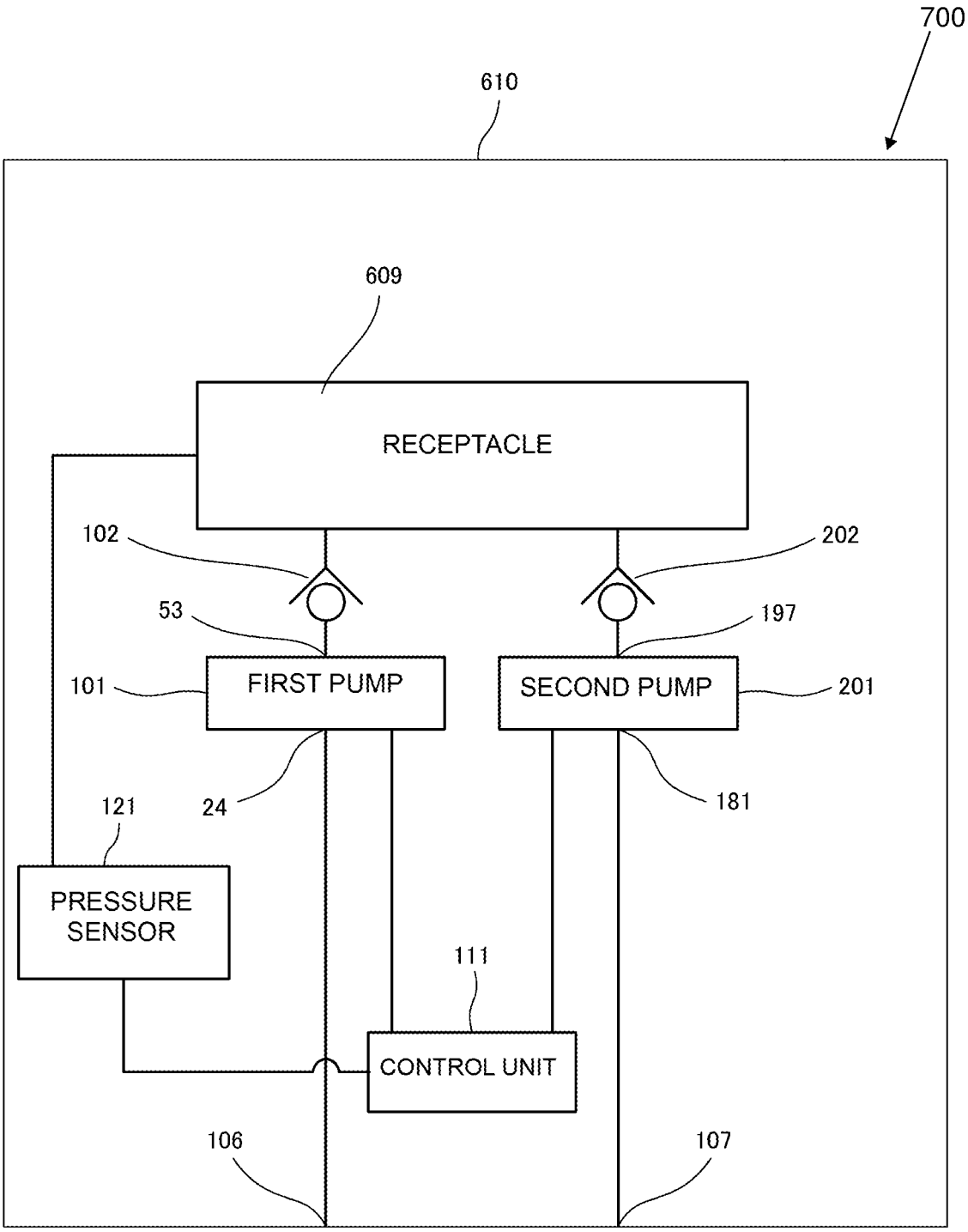
FIG. 27 is a block diagram illustrating the configuration of the primary elements of a gas control device 700 according to a seventh embodiment of the present disclosure.

FIG. 27 is a block diagram illustrating the configuration of the primary elements of a gas control device 700 according to a seventh embodiment of the present disclosure. The gas control device 700 differs from the gas control device 600 according to the sixth embodiment in that the gas control device 700 includes the pressure sensor 121. The rest of the configuration is the same and thus descriptions thereof will be omitted.

To describe in detail, the pressure sensor 121 detects the pressure (air pressure) in the receptacle 609 and outputs a resulting detection signal to the control unit 111.

The control unit 111 monitors the pressure (air pressure) in the receptacle 609 using the detection signal outputted from the pressure sensor 121. The control unit 111 specifies timings for the start of driving to each pump on the basis of the value of the air pressure in the receptacle 609.

The control unit 111 keeps the second pump 201 off from when the driving of the first pump 101 starts to when the air pressure in the receptacle 609 drops below a predetermined pressure, and turns the second pump 201 on once the air pressure in the receptacle 609 has dropped below the predetermined pressure.

According to the gas control device 700, the control unit 111 turns the second pump 201 on in accordance with the air pressure in the receptacle 609.

As such, the gas control device 700 according to the seventh embodiment can provide the same effects as the gas control device 600 according to the sixth embodiment.

Other Embodiments

Although air is described as the gas in the above-described embodiments, the gas is not limited thereto. The present disclosure can also be applied in the case where the gas is another gas aside from air.

In addition, although an air bladder is used as the receptacle and a massage device is used as the gas control device in the above-described embodiments, those elements are not limited thereto. The embodiments can also be applied in a receptacle aside from an air bladder, such as a beach ball, a rubber boat, a toy such as an inflatable doll, or a tire, for example, and can also be applied in the case where the gas control device is another gas control device aside from a massage device.

In the case where a receptacle aside from an air bladder is used, the high flow rate characteristics and high pressure characteristics of the gas control device are used in accordance with the PQ characteristics required by that receptacle. For example, although the second pump 201 is turned on after the first pump 101 is turned on in the gas control device 100, depending on the PQ characteristics required by the receptacle, the first pump 101 may be turned on after the second pump 201 is turned on.

Figure 5:
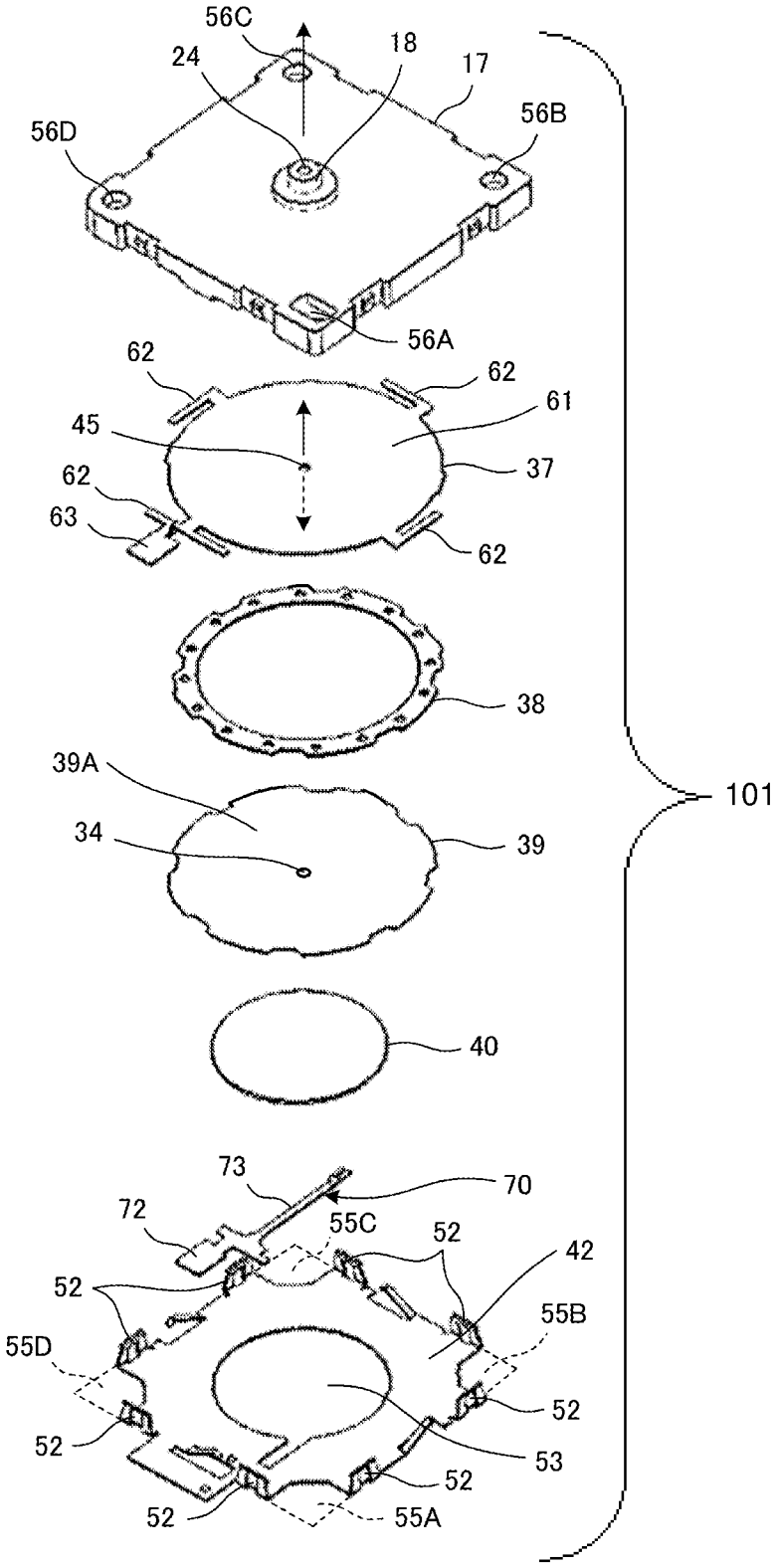
FIG. 5 is an exploded perspective view of the first pump 101 indicated in FIG. 1.
Figure 10:
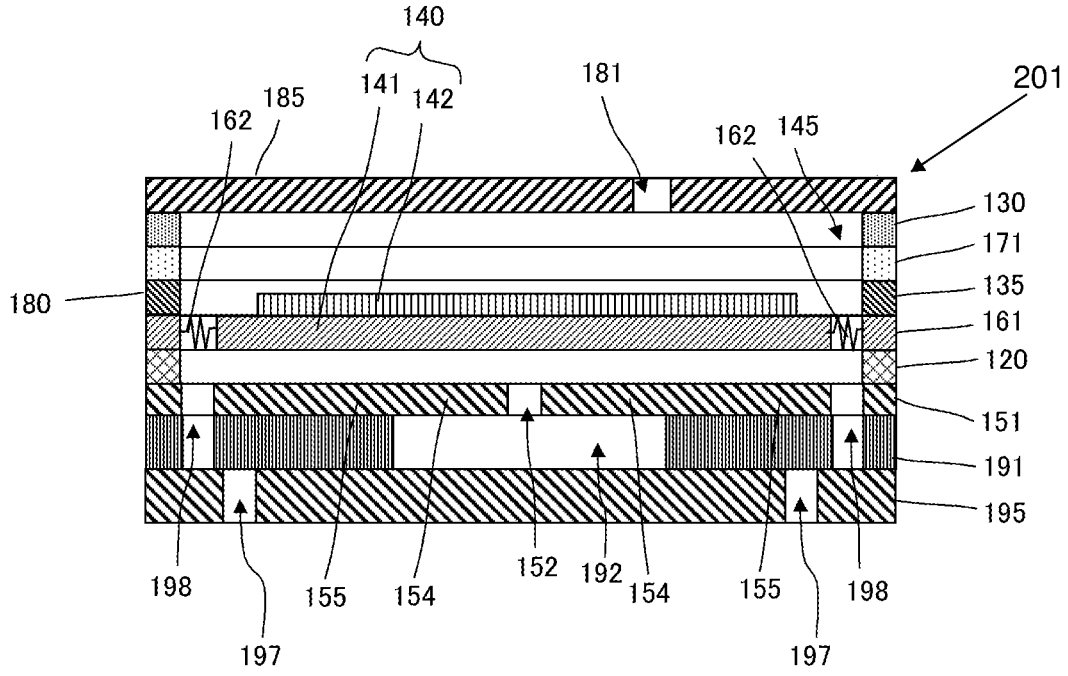
FIG. 10 is a cross-sectional view of the second pump 201 indicated in FIG. 8, taken along a T-T line.

In addition, although the first pump 101 configured as illustrated in FIGS. 4 to 6 is used as a first pump and the second pump 201 configured as illustrated in FIGS. 8 to 10 is used as a second pump in the above-described embodiments, the pumps are not limited thereto.

Likewise, although the third pump 301 configured as illustrated in FIGS. 8 to 10 is used as a third pump and the fourth pump 401 configured as illustrated in FIGS. 4 to 6 is used as a fourth pump, the pumps are not limited thereto. The embodiments can also be applied using other pumps aside from the first pump 101, the second pump 201, the third pump 301, and the fourth pump 401 (electromagnetic pumps or the like, for example).

In addition, although the gas control devices 100, 200, 300, 400, and 500 according to the above-described embodiments include the first check valve 102 and the second check valve 202, the configurations are not limited thereto. For example, the gas control device need not include the first check valve and the second check valve in the case where the first pump and the second pump have check functions, for example.

In addition, although the first pump 101 is kept on even after the second pump 201 is turned on in the above-described embodiments as indicated in FIG. 12, the control unit 111 may turn the first pump 101 off after turning the second pump 201 on.

On the other hand, although the control unit 111 turns the first pump 101 off after turning the second pump 201 on in the above-described embodiments as indicated in FIGS. 16 and 17, the first pump 101 may be kept on even after the second pump 201 is turned on.

In the same manner, although the control unit 111 turns the first pump 101 and the fourth pump 401 off after turning the second pump 201 on in the above-described embodiments as indicated in FIG. 21, the first pump 101 and the fourth pump 401 may be kept on even after the second pump 201 is turned on.

In addition, although the piezoelectric element is constituted of a PZT-based ceramic material in the above-described embodiments, the embodiments are not limited thereto. For example, the piezoelectric element may be formed from a piezoelectric material of a non-leaded piezoelectric ceramic material such as a potassium sodium niobate-based ceramic material, an alkali niobate-based ceramic material, or the like.

In addition, although a unimorph-type piezoelectric vibrator in which a piezoelectric element is provided on one surface of a vibrating plate is used in the above-described embodiments as indicated in FIGS. 5, 6, 9, and 10, the piezoelectric element is not limited thereto. A bimorph-type piezoelectric vibrator in which piezoelectric elements are provided on both sides of the vibrating plate may be used as well.

In addition, although a circular plate-shaped piezoelectric element, a circular plate-shaped vibrating plate, and a circular plate-shaped top plate are used in the above-described embodiments, these elements are not limited to such a shape. These elements may be rectangular plates, polygonal plates, elliptical plates, or the like, for example.

In addition, although the piezoelectric pumps are resonance-driven at the frequency (base wave) of the primary vibrating mode of the pump main body in the above-described embodiments, the driving is not limited thereto. In practice, the pumps may be resonance-driven at a frequency of an odd-number order vibrating mode of three or more, having a plurality of vibration bellies.

In addition, although the above-described embodiments indicate examples in which the top plate 37 bends and vibrates in a concentric circle shape in accordance with the bending vibration of the vibrating plate 39 as indicated in FIGS. 7A and 7B, the present disclosure is not limited thereto. In practice, it is sufficient for only the vibrating plate 39 to bend and vibrate, and the top plate 37 need not bend and vibrate in accordance with the bending vibration of the vibrating plate 39.

Finally, the above-described embodiments are to be understood in all ways as exemplary and in no ways limiting. The scope of the present disclosure is defined not by the above embodiments but by the scope of the appended claims. Furthermore, the scope of the present disclosure is intended to include all modifications within the scope and meaning equivalent to the scope of the appended claims.

9 . . . RECEPTACLE
17 . . . OUTER HOUSING
18 . . . NOZZLE
24 . . . DISCHARGE HOLE
31 . . . VENTILATION CHANNEL
36 . . . PUMP CHAMBER
37 . . . TOP PLATE
38 . . . SIDE PLATE
39 . . . VIBRATING PLATE
40 . . . PIEZOELECTRIC ELEMENT
42 . . . CAP
45 . . . VENTILATION HOLE
52 . . . PROJECTING PORTION
53 . . . SUCTION HOLE
55A . . . CUTOUT
56A . . . SCREW HOLE
61 . . . CENTRAL PORTION
62 . . . PROJECTING PORTION
63 . . . EXTERNAL TERMINAL
70 . . . ELECTRODE CONDUCTING PLATE
72 . . . EXTERNAL TERMINAL
73 . . . INTERNAL TERMINAL
100 . . . GAS CONTROL DEVICE
101 . . . FIRST PUMP
102 . . . FIRST CHECK VALVE
106 . . . FIRST VENTILATION HOLE
107 . . . SECOND VENTILATION HOLE
108 . . . THIRD VENTILATION HOLE
110 . . . HOUSING
111 . . . CONTROL UNIT
120 . . . SPACER
121 . . . PRESSURE SENSOR
130 . . . SPACER
135 . . . SPACER
140 . . . ACTUATOR
141 . . . VIBRATING PLATE
142 . . . PIEZOELECTRIC ELEMENT
145 . . . PUMP CHAMBER
151 . . . FLEXIBLE PLATE
152 . . . VENTILATION HOLE
153 . . . EXTERNAL TERMINAL
154 . . . MOBILE PORTION
155 . . . FIXED PORTION
160 . . . VIBRATING PLATE UNIT
161 . . . FRAME PLATE
162 . . . CONNECTING PORTION
170 . . . ELECTRODE CONDUCTING PLATE
171 . . . FRAME SECTION
172 . . . EXTERNAL TERMINAL
173 . . . INTERNAL TERMINAL
180 . . . PUMP HOUSING
181 . . . DISCHARGE HOLE
185 . . . LID PLATE
191 . . . SUBSTRATE
192 . . . CAVITY
193 . . . FLOW CHANNEL
195 . . . COVER PLATE
197 . . . SUCTION HOLE
198 . . . HOLE PORTION
200 . . . GAS CONTROL DEVICE
201 . . . SECOND PUMP
202 . . . SECOND CHECK VALVE
300 . . . GAS CONTROL DEVICE
301 . . . THIRD PUMP
302 . . . CHECK VALVE
310 . . . HOUSING
400 . . . GAS CONTROL DEVICE
401 . . . FOURTH PUMP
500 . . . GAS CONTROL DEVICE
600 . . . GAS CONTROL DEVICE

609 . . . RECEPTACLE
610 . . . HOUSING
700 . . . GAS CONTROL DEVICE

The invention claimed is:

1. A gas control device comprising:

a first pump having a first suction hole and a first discharge hole for a gas; and a second pump having a second suction hole and a second discharge hole for the gas, wherein the gas control device is adapted so that a maximum flow rate of the gas discharged by the first pump from the first discharge hole is greater than a maximum flow rate of the gas discharged by the second pump from the second discharge hole;

a maximum pressure of the gas discharged by the second pump from the second discharge hole is greater than a maximum pressure of the gas discharged by the first pump from the first discharge hole;

the first discharge hole and the second discharge hole are connected to a receptacle having a volume changed in accordance with a pressure of the gas flowing into the receptacle; and the second pump includes:

a piezoelectric element serving as an actuator, a vibrating plate, wherein the vibrating plate has a first main surface bonded to the piezoelectric element, and bends and vibrates due to the piezoelectric element expanding and contracting, a frame plate surrounding a periphery of the vibrating plate, a connecting portion connecting the vibrating plate to the frame plate and elastically supporting the vibrating plate on the frame plate, and a plate opposing a second main surface of the vibrating plate on a side opposite from the first main surface and having a ventilation hole provided.

2. The gas control device according to claim 1, comprising:

a first check valve for preventing the gas from flowing to the first discharge hole from an interior of the receptacle.

3. The gas control device according to claim 2, comprising:

a second check valve that prevents the gas from flowing to the second discharge hole from the interior of the receptacle.

4. The gas control device according to claim 2, comprising:

a detecting unit for detecting a pressure of the gas in the receptacle; and a control unit for starting driving one of the first pump and the second pump, wherein the control unit monitors the pressure of the gas in the receptacle on the basis of an output of the detecting unit after starting driving the one of the first pump and the second pump, and starts driving another one of the first pump and the second pump in response to a rise in the pressure.

5. The gas control device according to claim 2, comprising:

a third pump having a third suction hole and a third discharge hole for the gas, wherein the maximum flow rate of the gas discharged by the first pump from the first discharge hole is greater than a maximum flow rate of the gas discharged by the third pump from the third discharge hole;

a maximum pressure of the gas discharged by the third pump from the third discharge hole is greater than the maximum pressure of the gas discharged by the first pump from the first discharge hole; and the third discharge hole is connected to the second suction hole.

6. The gas control device according to claim 1, comprising:

a second check valve that prevents the gas from flowing to the second discharge hole from an interior of the receptacle.

7. The gas control device according to claim 6, comprising:

a detecting unit for detecting a pressure of the gas in the receptacle; and a control unit for starting driving one of the first pump and the second pump, wherein the control unit monitors the pressure of the gas in the receptacle on the basis of an output of the detecting unit after starting driving the one of the first pump and the second pump, and starts driving another one of the first pump and the second pump in response to a rise in the pressure.

8. The gas control device according to claim 6, comprising:

a third pump having a third suction hole and a third discharge hole for the gas, wherein the maximum flow rate of the gas discharged by the first pump from the first discharge hole is greater than a maximum flow rate of the gas discharged by the third pump from the third discharge hole;

a maximum pressure of the gas discharged by the third pump from the third discharge hole is greater than the maximum pressure of the gas discharged by the first pump from the first discharge hole; and the third discharge hole is connected to the second suction hole.

9. The gas control device according to claim 1, comprising:

a detecting unit for detecting a pressure of the gas in the receptacle; and a control unit for starting driving one of the first pump and the second pump, wherein the control unit monitors the pressure of the gas in the receptacle on the basis of an output of the detecting unit after starting driving the one of the first pump and the second pump, and starts driving another one of the first pump and the second pump in response to a rise in the pressure.

10. The gas control device according to claim 9, comprising:

a third pump having a third suction hole and a third discharge hole for the gas, wherein the maximum flow rate of the gas discharged by the first pump from the first discharge hole is greater than a maximum flow rate of the gas discharged by the third pump from the third discharge hole;

a maximum pressure of the gas discharged by the third pump from the third discharge hole is greater than the maximum pressure of the gas discharged by the first pump from the first discharge hole; and the third discharge hole is connected to the second suction hole.

11. The gas control device according to claim 1, comprising:

a third pump having a third suction hole and a third discharge hole for the gas, wherein the gas control device is adapted so that the maximum flow rate of the gas discharged by the first pump from the first discharge hole is greater than a maximum flow rate of the gas discharged by the third pump from the third discharge hole;

a maximum pressure of the gas discharged by the third pump from the third discharge hole is greater than the maximum pressure of the gas discharged by the first pump from the first discharge hole; and the third discharge hole is connected to the second suction hole.

12. The gas control device according to claim 1, comprising:

a fourth pump having a fourth suction hole and a fourth discharge hole for the gas, wherein the gas control device is adapted so that a maximum flow rate of the gas discharged by the fourth pump from the fourth discharge hole is greater than the maximum flow rate of the gas discharged by the second pump from the second discharge hole;

the maximum pressure of the gas discharged by the second pump from the second discharge hole is greater than a maximum pressure of the gas discharged by the fourth pump from the fourth discharge hole; and the fourth discharge hole is connected to the receptacle.

13. The gas control device according to claim 1, wherein the first pump and the second pump are connected in parallel to the receptacle.

14. The gas control device according to claim 13, comprising:

a first check valve that prevents the gas from flowing to the first discharge hole from an interior of the receptacle, and a second check valve that prevents the gas from flowing to the second discharge hole from the interior of the receptacle;

wherein the first pump and second pump are connected in parallel to the receptacle with the first check valve interposed between the first pump and receptacle and the second check valve interposed between the second pump and receptacle such that gas discharged by each of the first pump and second pump is prevented from flowing into the other of the first pump and second pump.

15. A gas control device comprising:

a first pump having a first suction hole and a first discharge hole for a gas; and a second pump having a second suction hole and a second discharge hole for the gas, wherein the gas control device is adapted so that a maximum flow rate of the gas discharged by the first pump from the first discharge hole is greater than a maximum flow rate of the gas discharged by the second pump from the second discharge hole;

a maximum pressure of the gas discharged by the second pump from the second discharge hole is greater than a maximum pressure of the gas discharged by the first pump from the first discharge hole;

the first discharge hole and the second discharge hole are connected to a receptacle having a volume changed in accordance with a pressure of the gas flowing into the receptacle;

the first pump includes:

a piezoelectric element serving as an actuator, a vibrating plate, wherein the vibrating plate has a first main surface bonded to the piezoelectric element, and bends and vibrates due to the piezoelectric element expanding and contracting, a first housing bonded to the vibrating plate and forming a pump chamber along with the vibrating plate, and a second housing covering the first housing with a gap provided between the first housing and the second housing and forming a ventilation channel between the first housing and the second housing;

a ventilation hole for allowing the interior and the exterior of the pump chamber to communicate is provided in the first housing; and the discharge hole is provided in a region of the second housing opposing the ventilation hole.

16. A gas control device comprising:

a first pump having a first suction hole for a gas; and a second pump having a second suction hole for the gas, wherein the gas control device is adapted so that a maximum flow rate of the gas suctioned by the first pump is greater than a maximum flow rate of the gas suctioned by the second pump;

a maximum pressure of the gas suctioned by the second pump is greater than a maximum pressure of the gas suctioned by the first pump;

the first pump and the second pump are connected to a receptacle having a volume changed in accordance with a pressure of the gas remaining in the receptacle; and the second pump includes:

a piezoelectric element serving as an actuator, a vibrating plate, wherein the vibrating plate has a first main surface bonded to the piezoelectric element, and bends and vibrates due to the piezoelectric element expanding and contracting, a frame plate surrounding a periphery of the vibrating plate, a connecting portion connecting the vibrating plate to the frame plate and elastically supporting the vibrating plate on the frame plate, and a plate opposing a second main surface of the vibrating plate on a side opposite from the first main surface and having a ventilation hole provided.

17. The gas control device according to claim 16, wherein the first suction hole and the second suction hole are connected to the receptacle.

18. The gas control device according to claim 17, comprising:

a check valve for preventing the gas from flowing into the receptacle from the first suction hole.

19. The gas control device according to claim 17, comprising:

a check valve for preventing the gas from flowing into the receptacle from the second suction hole.

20. The gas control device according to claim 17, comprising:

a detecting unit for detecting a pressure of the gas in the receptacle; and a control unit for starting driving one of the first pump and the second pump, wherein the control unit monitors the pressure of the gas in the receptacle on the basis of an output of the detecting unit after starting driving the one of the first pump and the second pump, and starts driving another one of the first pump and the second pump in response to a drop in the pressure.

21. A gas control device comprising:

a first pump having a first suction hole for a gas; and a second pump having a second suction hole for the gas, wherein the gas control device is adapted so that a maximum flow rate of the gas suctioned by the first pump is greater than a maximum flow rate of the gas suctioned by the second pump;

a maximum pressure of the gas suctioned by the second pump is greater than a maximum pressure of the gas suctioned by the first pump;

the first pump and the second pump are connected to a receptacle having a volume changed in accordance with a pressure of the gas remaining in the receptacle;

the first pump includes:

a piezoelectric element serving as an actuator, a vibrating plate, wherein the vibrating plate has a first main surface bonded to the piezoelectric element, and bends and vibrates due to the piezoelectric element expanding and contracting, a first housing bonded to the vibrating plate and forming a pump chamber along with the vibrating plate, and a second housing covering the first housing with a gap provided between the first housing and the second housing and forming a ventilation channel between the first housing and the second housing;

a ventilation hole for allowing the interior and the exterior of the pump chamber to communicate is provided in the first housing; and a discharge hole is provided in a region of the second housing opposing the ventilation hole.

* * * * *